US008511676B2

(12) United States Patent
Kitamura

(10) Patent No.: US 8,511,676 B2
(45) Date of Patent: Aug. 20, 2013

(54) MEDIUM FEEDING DEVICE AND IMAGE FORMING APPARATUS

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/352,385

(22) Filed: Jan. 18, 2012

(65) Prior Publication Data

US 2012/0187620 A1 Jul. 26, 2012

(30) Foreign Application Priority Data

Jan. 19, 2011 (JP) ..... 2011-008443

(51) Int. Cl.
*B65H 1/14* (2006.01)

(52) U.S. Cl.
USPC ..... 271/152; 271/153; 271/154; 271/155

(58) Field of Classification Search
USPC ..... 271/10.1, 147, 152, 153, 154, 155
See application file for complete search history.

(56) References Cited

U.S. PATENT DOCUMENTS

| | | | | |
|---|---|---|---|---|
| 5,501,444 | A * | 3/1996 | Yukimachi et al. | 271/127 |
| 6,824,133 | B2 * | 11/2004 | Richtsmeier | 271/153 |
| 6,994,341 | B2 * | 2/2006 | Aoki et al. | 271/117 |
| 7,222,847 | B2 * | 5/2007 | Yamamoto | 271/153 |
| 7,441,767 | B2 * | 10/2008 | Saito | 271/147 |
| 7,984,902 | B2 * | 7/2011 | Kuroda | 271/156 |
| 8,152,159 | B2 * | 4/2012 | Okumura | 271/127 |
| 8,177,216 | B2 * | 5/2012 | Watase et al. | 271/9.13 |
| 2004/0251600 | A1 * | 12/2004 | Amamoto | 271/152 |
| 2011/0140341 | A1 * | 6/2011 | Nishikata et al. | 271/3.09 |
| 2011/0233851 | A1 * | 9/2011 | Sugishima | 271/153 |

FOREIGN PATENT DOCUMENTS

JP 2005-350264 A 12/2005

* cited by examiner

*Primary Examiner* — Kaitlin Joerger
(74) *Attorney, Agent, or Firm* — Panitch Schwarze Belisario & Nadel LLP

(57) ABSTRACT

A medium feeding device includes a medium placing member, a feeding mechanism for feeding the medium, and a lifting unit for moving the medium placing member toward the feeding mechanism. A first switching unit connects a transmission of a driving force from a driving source to the lifting unit based on a shifting of the feeding mechanism. A second switching unit connects the transmission based on control by a control unit. The control unit causes the second switching unit to transmit the driving force to the lifting unit to move the medium placing member upward based on detection by a medium detecting unit. When the medium placing member moves upward to a predetermined position, the first switching unit disconnects the transmission, holding the medium placing member at the predetermined position. The control unit causes the second switching unit to disconnect the transmission so that the medium placing member moves downward.

19 Claims, 30 Drawing Sheets

MEDIUM FEEDING DEVICE AND IMAGE FORMING APPARATUS

BACKGROUND OF THE INVENTION

The present invention relates to a medium feeding device for feeding a medium such as a printing paper, and an image forming apparatus having the medium feeding device.

A general image forming apparatus includes a medium feeding device that feeds a medium, and an image forming portion that forms an image on the medium using electrophotography. The medium feeding device includes a medium placing plate on which a stack of the media is placed, and a pickup roller provided so as to contact the uppermost medium of the stack on the medium. The pickup roller feeds the media one by one.

In order to ensure that the pickup roller feeds the media one by one, a height of the medium placing plate needs be adjusted. Therefore, there is proposed a medium feeding device including a spring is provided so as to press the medium placing from below, and an elevating arm is provided so as to abut against the medium placing plate from above. The height of the medium placing plate is controlled by driving the elevating arm using an exclusive motor (see, for example, Japanese Laid-open Patent Publication No. 2005-3520264). The medium feeding device further includes a height sensor for detecting a height of the medium placed on the medium placing plate, and a position sensor for detecting a home-position of the elevating arm.

However, the conventional medium feeding device needs to be provided with an exclusive motor for moving the medium placing plate upward and downward.

SUMMARY OF THE INVENTION

In an aspect of the present invention, it is intended to provide a medium feeding device and an image forming unit capable of moving a medium upward and downward without using an exclusive motor.

According to an aspect of the present invention, there is provided a medium feeding device including a main body, a medium placing member mounted to the main body so that the medium placing member is movable upward and downward, a feeding mechanism shiftably mounted to the main body, the feeding mechanism contacting a surface of the medium and feeding the medium in a predetermined direction, a conveying mechanism for conveying the medium fed by the feeding mechanism, a lifting unit that moves the medium placing member toward the feeding mechanism, a medium detecting unit for detecting presence and absence of the medium on the medium placing member, a driving source for driving at least one of the lifting unit and the conveying mechanism, a driving force transmission unit for transmitting a driving force of the driving source to the lifting unit, and a control unit that controls the driving source. The driving force transmission unit includes a first switching unit that connects or disconnects a transmission of the driving force from the driving source to the lifting unit based on a shifting of the feeding mechanism caused by a movement of the medium placing member, and a second switching unit that connects or disconnects a transmission of the driving force from the driving source to the lifting unit based on control by the control unit. The control unit causes the second switching unit to transmit the driving force to the lifting unit so as to move the medium placing member upward based on detection by the medium detecting unit. When the medium placing member moves upward to a predetermined position, the first switching unit disconnects the transmission of the driving force to the lifting unit, so that the medium placing member is held at the predetermined position. The control unit causes the second switching unit to disconnect the transmission of the driving force to the lifting unit so that the medium placing member moves downward.

With such a configuration, it is not necessary to provide an exclusive motor for moving the medium placing member upward.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the attached drawings. Descriptions will be made of a color printer as an example of an image forming apparatus in which an image forming unit of the present invention is mounted.

First Embodiment

Figure 1:
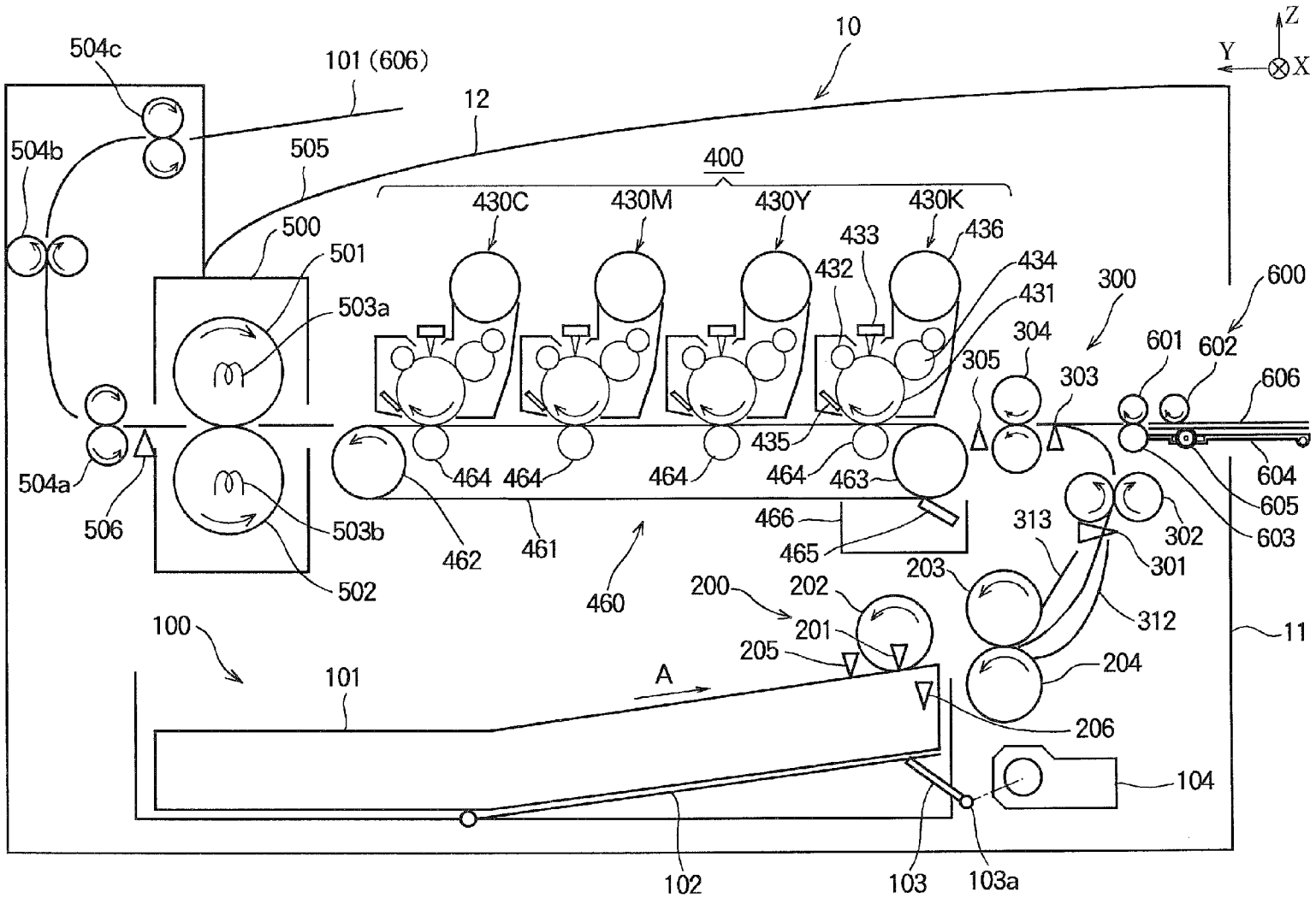
FIG. 1 is a side view showing a basic configuration of an image forming apparatus according to the first embodiment of the present invention.

FIG. 1 is a schematic view showing an image forming apparatus 10 according to the first embodiment of the present invention. The image forming apparatus 1 includes a sheet tray 100 in which a stack of sheets (media) 101 is stored. The sheet tray 100 is detachably mounted to a lower part of a main body 11 of the image forming apparatus 10. The sheet tray 100 includes a sheet placing plate 102 for placing the sheets 101 thereon, and a lift-up lever 103 for lifting the sheet placing plate 102, and a pickup roller 202 for individually feeding the sheets 101 on the sheet placing plate 102.

The sheet placing plate 102 is swingably supported at a not shown supporting shaft. The lift-up lever 103 is provided on a feeding side (i.e., the right in FIG. 1) of the sheet tray 100. The lift-up lever 103 is mounted to a rotation shaft 103*a* rotated by a lift-up motor 104. A driving force of the lift-up motor 104 is releasably transmitted to the rotation shaft 103*a*. The sheet tray 100 includes an upward movement detecting unit 201 for detecting that the uppermost sheet 101 of the stack on the sheet placing plate 102 reaches a predetermined height (i.e., a height at which the uppermost sheet the contacts the pickup roller 202), a sheet remaining amount detecting sensor 205 for detecting a remaining amount of the sheets 101 on the sheet placing plate 102.

When the sheet tray 100 is mounted to the main body 11 of the image forming apparatus 10, the lift-up lever 103 is connected to the lift-up motor 104, and the driving force of the lift-up motor 104 becomes transmittable to the lift-up lever 103. When a control unit 62 (not shown) of the image forming apparatus 10 drives the lift-up motor 104, the lift-up lever 103 rotates to thereby lift the sheet placing plate 102 upward, and the sheets 101 placed on the sheet placing plate 102 moves upward. When the uppermost sheet 101 reaches a predetermined height to contact the pickup roller 202, the control unit 62 stops the lift-up motor 104 based on a detection signal outputted by the upward movement detecting unit 201. In this state, the pickup roller 202 rotates to feed the sheet 101 on the sheet placing plate 102.

A feeding roller 203 and a retard roller 204 are provided on a feeding side (i.e., right side) of the pickup roller 202. The feeding roller 203 and the retard roller 204 contact each other. The pickup roller 202, the feeding roller 203 and the retard roller 204 constitute a sheet feeding portion 200. The pickup roller 202 and the feeding roller 203 are rotated by a feeding motor 72 (FIG. 17) indirections shown by arrows in FIG. 1. The pickup roller 202 an the feeding roller 203 respectively have one-way clutches therein, and are able to rotate idly even when the feeding motor 72 stops.

The pickup roller 202 contacts the uppermost sheet 101 of the stack placed on the sheet placing plate 102, and rotates so as to feed the sheet 101. The retard roller 204 generates a torque in a direction shown by an arrow in FIG. 1. Even when the pickup roller 202 feeds a plurality of the sheets 101, the feed roller 203 and the retard roller 204 separate the sheets 101 so as to individually feed the sheets 101 into a conveying path.

At a downstream side of the sheet feeding portion 200 in a conveying direction of the sheet 101, a pair of conveying rollers 302 for correcting a skew of the sheet 101, guide members 312 and 313 for guiding the sheet 101 from the sheet feeding portion 200 to the conveying rollers 302, and another pair of conveying rollers 304 for conveying the sheet 101 to an image forming portion 400 described later.

Further, a sheet sensor 301 for detecting a passage of the sheet 101 is provided at a downstream side of the conveying rollers 302 in the conveying direction of the sheet 101. A sheet sensor 303 for determining rotation-start timing of the conveying rollers 304 and a writing sensor for determining writing-start timing at the image forming unit 400 are respectively provided on an upstream side and a downstream side of the conveying rollers 304.

Figure 17:
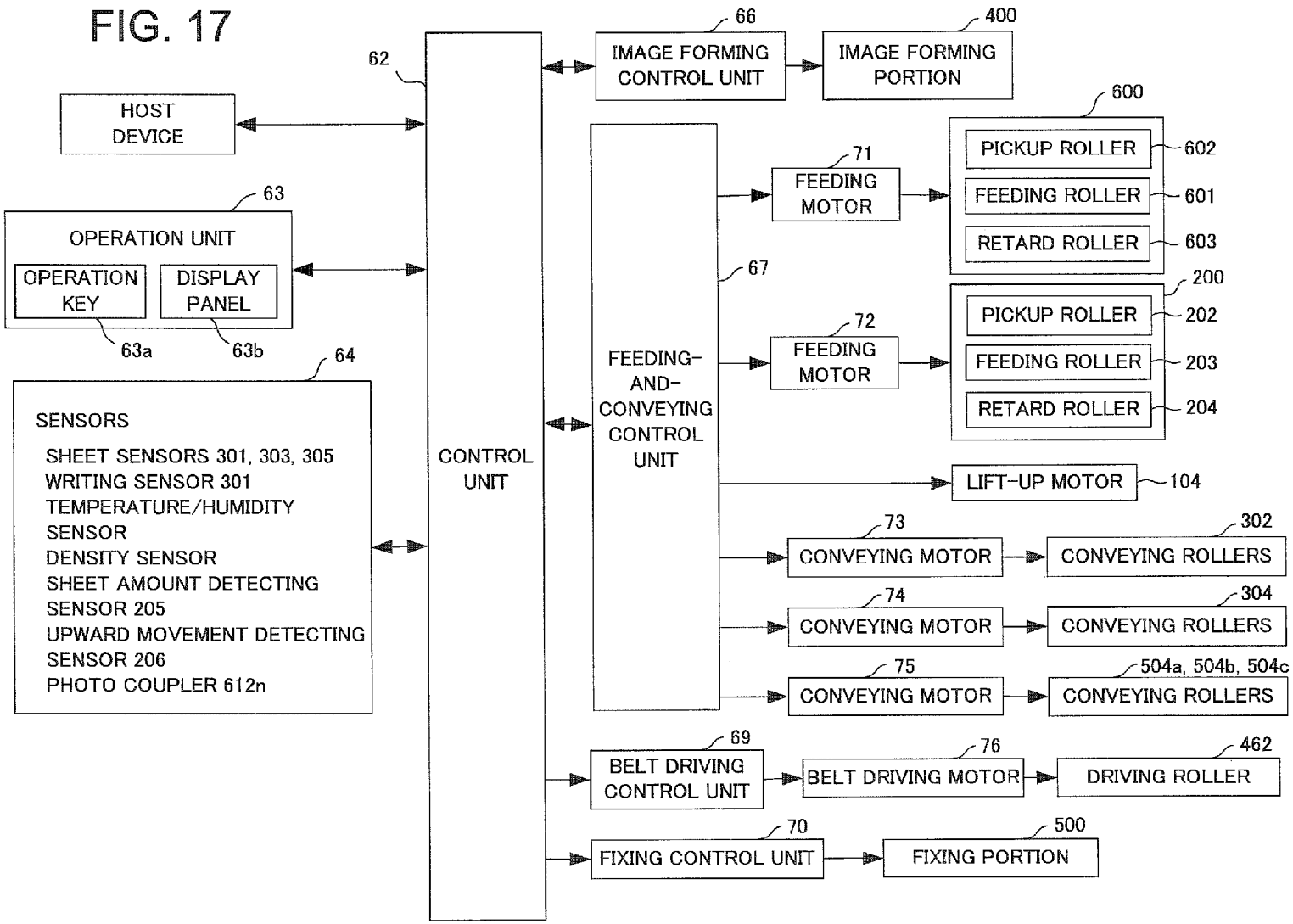
FIG. 17 is a block diagram showing a control system of the image forming apparatus according to the first embodiment of the present invention.

The conveying rollers 302 and 304 are respectively rotated by driving forces transmitted from conveying motors 73 and 74 (FIG. 17) via not shown gears or the like, and controlled by a feeding-and-conveying control unit 67 (FIG. 17).

A multi-purpose tray (MPT) 600 as a medium feeding device is provided on a side (i.e., a right side in FIG. 1) of the image forming apparatus 10. The MPT 600 includes a sheet placing plate 604 as a medium placing plate for placing a stack of sheets 606 as media, a pickup roller 602 as a feeding mechanism for individually feeding the sheets 606 on the sheet placing plate 604, a feeding roller 601 for feeding the sheet 606 (fed by the sheet placing plate 604) to the main body 11 of the image forming apparatus 10, and a retard roller 603 provided contacting the feeding roller 601 for separating the sheets 11 fed by the pickup roller 602. A detailed description of the MPT 600 will be made later.

The image forming apparatus 10 includes the image forming portion 400 including four process units 430K, 430Y, 430M and 430C that form images using toners (i.e., developers) of yellow, magenta, cyan and black. The process units 430K, 430Y, 430M and 430C are arranged in this order from an upstream side (i.e., the right in FIG. 1) of the conveying path of the sheet 101. The process units 430K, 430Y, 430M and 430C are detachably mounted to the main body 11 of the image forming apparatus 10. The process units 430K, 430Y, 430M and 430C have the same configuration, and are collectively referred to as the process unit 430.

The process unit 430 includes a photosensitive drum 431 as a latent image bearing body. The photosensitive drum 431 is rotatably supported, and is rotated by a not shown motor in a direction shown by an arrow in FIG. 1. Along a circumference of the photosensitive drum 431, a charging roller 432 as a charging member, an exposure device 433, a developing roller 434 as a developer bearing body, and a cleaning blade 435 as a cleaning member are arranged in this order in a rotating direction of the photosensitive drum 431. The charging roller 432 uniformly charges a surface of the photosensitive drum 431. The exposure device 433 exposes the surface of the photosensitive drum 431 based on image date to form a latent image. The developing roller 434 develops the latent image on the surface of the photosensitive drum 431 to form a toner image. The cleaning blade 435 removes a residual toner (that remains on the surface of the photosensitive drum 431 after the toner image is transferred to the sheet) from the surface of the photosensitive drum 431.

A toner cartridge 436 as a developer storing portion for storing the toner to be supplied to the developing roller 432 is provided above the developing roller 434. Respective rollers and the photosensitive drum 341 are rotated by driving forces transmitted from not shown driving sources via gears or the like.

A transfer belt unit 460 is provided below the process units 430K, 430Y, 430M and 430C in FIG. 1. The transfer belt unit 460 includes a transfer belt (i.e., a conveying belt) 461 that electrostatically absorbs and conveys the sheet 101, further includes a driving roller 462 and a tension roller 463 around which the transfer belt 461 is stretched. The driving roller 462 is rotated by a driving force transmitted from a belt driving motor 76 (FIG. 17) via not shown gears or the like, and is controlled by a belt driving control unit 69 (FIG. 17) described later. The transfer belt 461 is moved by the rotation of the driving roller 462. Further, a cleaning blade 465 is provided for scraping off the toner adhering to the transfer belt 461, and a toner box 466 is provided for storing the scrapped-off by the cleaning blade 465.

Transfer rollers 464 are provided contacting the respective photosensitive drums 431 of the process units 430K, 430Y, 430M and 430C. The transfer rollers 464 are pressed against the photosensitive drums 431 via the transfer belt 461. Each of the transfer rollers 464 has a resilient surface layer composed of rubber or the like having an electrical conductivity. The transfer roller 464 is applied with an electric potential for generating a difference in electric potential between the surface of the transfer roller 464 and the photosensitive drum 431. Rotations of respective parts and voltages applied to respective parts of the image forming portion 400 are controlled by an image forming control unit 66 (FIG. 17).

A fixing portion 500 is provided at a downstream side (i.e., the left in FIG. 1) of the image forming unit 400 (i.e., the process cartridges 430K, 430Y, 430M and 430C) in the conveying direction of the sheet 101. The fixing portion 500 includes an upper roller 501 and a lower roller 502 respectively having resilient surface layers. The upper roller 501 and the lower roller 502 have halogen lamps 503*a* and 503*b* as internal heat sources. The fixing portion 500 applies heat and pressure to the toner image on the sheet 101 conveyed from the image forming portion 400, so that the toner image is molten and is fixed to the sheet 101. Operations of respective parts of the fixing portion 500 are controlled by a fixing control unit 70 (FIG. 17).

Three pairs of ejection rollers 504*a*, 504*b* and 504*c* are provided at a downstream side (i.e., the left in FIG. 1) of the fixing portion 500 in the conveying direction of the sheet 101. The ejection rollers 504*a*, 504*b* and 504*c* eject the sheet 101 to a stacker portion 505 provided on an upper cover 12 of the image forming apparatus 10. The ejection rollers 504*a*, 504*b* and 504*c* are rotated by a driving force transmitted from a conveying motor 75 (FIG. 17) via not shown gears or the like, and is controlled by the feeding-and-conveying control unit 67 (FIG. 17). A sheet sensor 506 is provided at a downstream side of the fixing portion 500 for determining rotation-start timings of the ejection rollers 504*a*, 504*b* and 504*c*.

Next, a configuration of the MPT 600 will be described.

Figure 2:
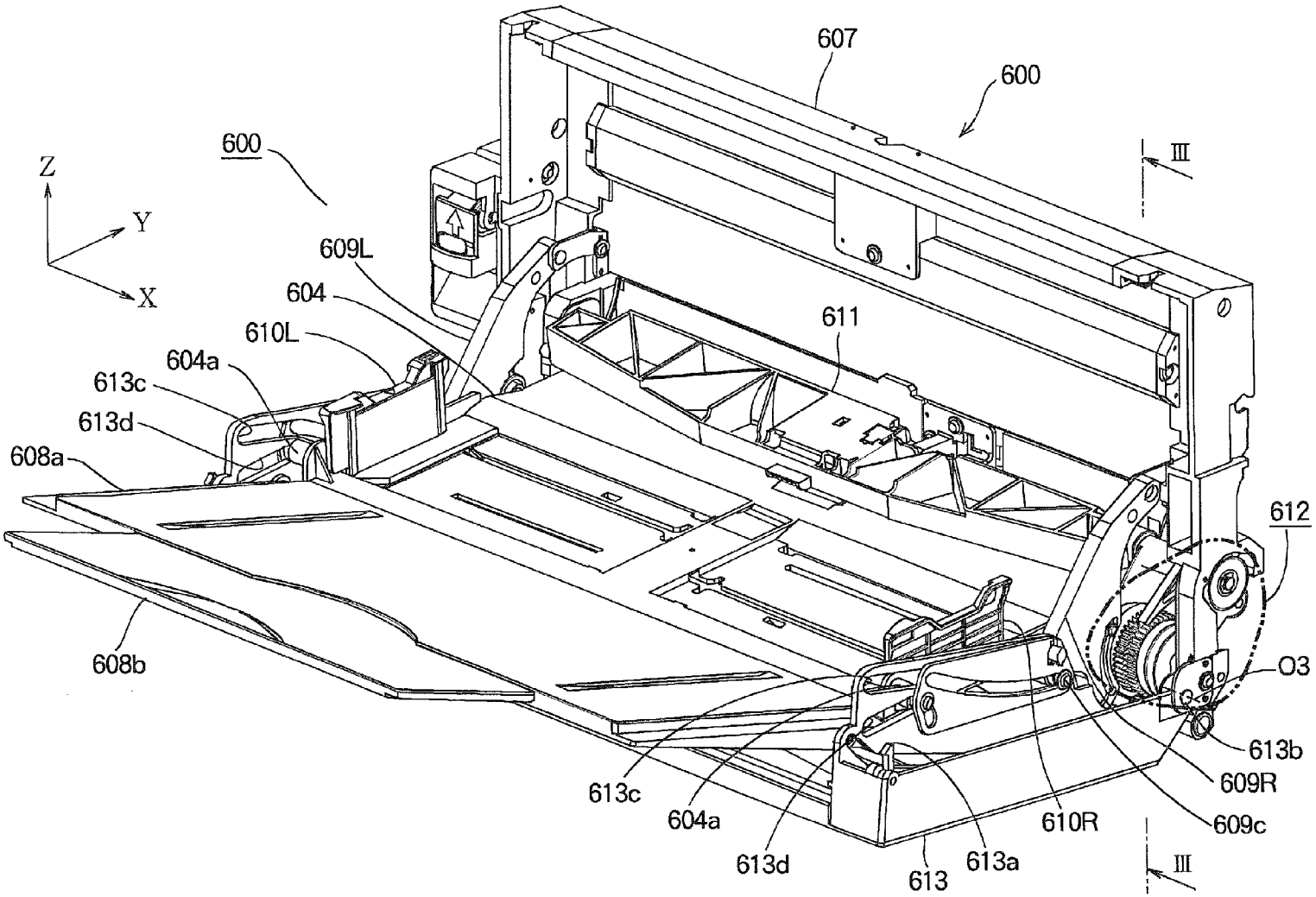
FIG. 2 is a perspective view showing an MPT according to the first embodiment of the present invention.
Figure 3:
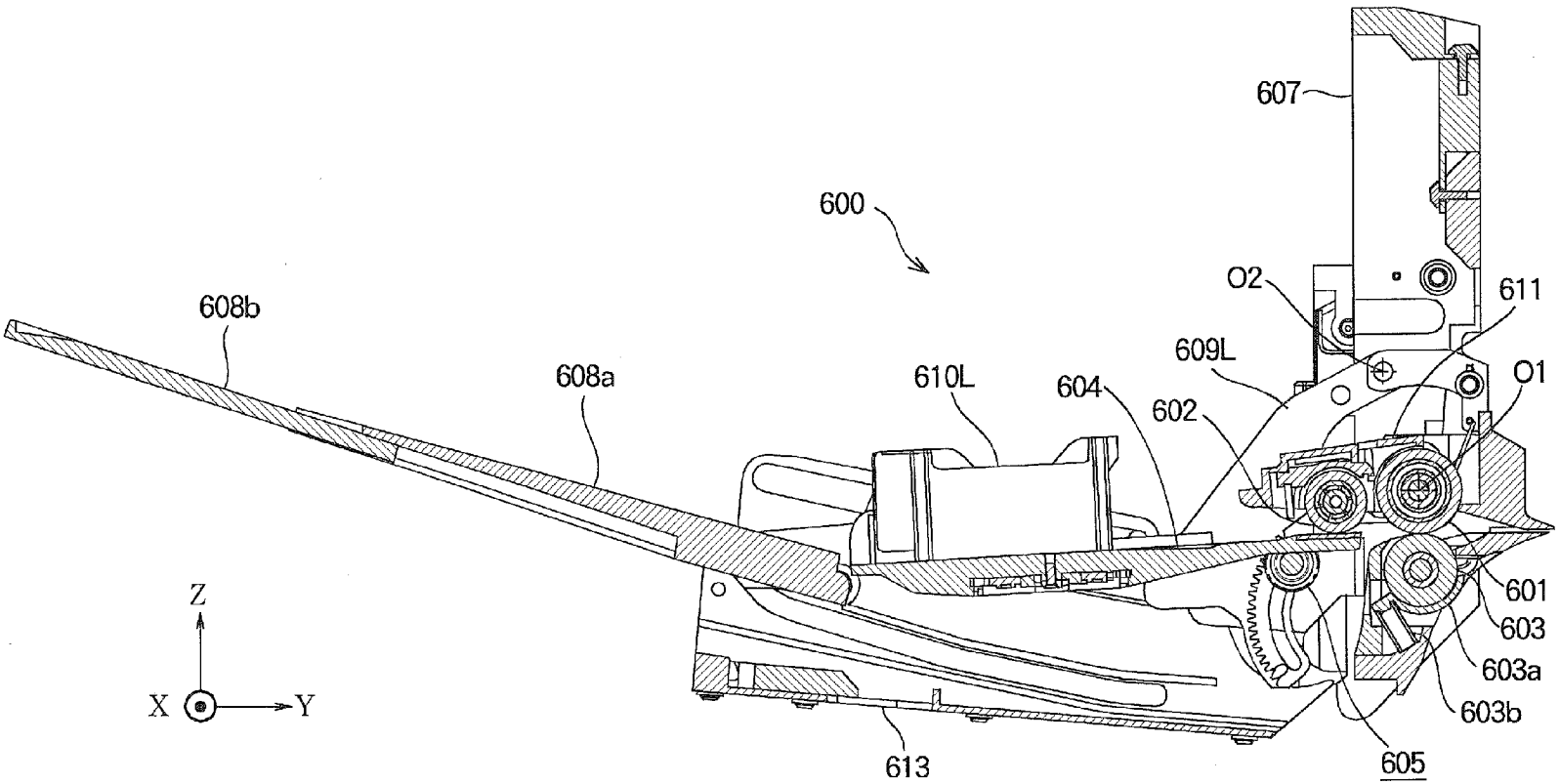
FIG. 3 is a sectional view showing an MPT according to the first embodiment of the present invention.

FIG. 2 is a perspective view showing the MPT 600. FIG. 3 is a sectional view taken along line III-III in FIG. 2. A vertical direction is defined as Z direction. In a plane (XY plane) perpendicular to the Z direction, a widthwise direction of the sheet stored in the MPT 600 is defined as X direction. A direction perpendicular to both of the X direction and the Z direction is defined as Y direction. The Y direction corresponds to a direction in which the sheet 606 is fed out from the MPT 600.

The MPT 600 includes a main frame 607 as a main body fixed to the main body 11 of the image forming apparatus 10, and a pickup frame 611 as a movable body mounted to the main frame 607 mounted to the main frame 607. The pickup frame 611 rotatably supports the feeding roller 601 and the pickup roller 602. The feeding roller 601 and the pickup roller 602 both have axial directions in the X direction, and are adjacent to each other in the Y direction. The pickup frame 611 is mounted to the main frame 607 so that the pickup frame 611 is swingable about an axis O1 (FIG. 3) in the X direction. The axis O1 also defines a rotation axis of the feeding roller 601.

An MPT cover 613 as a cover member is mounted to the main frame 607 so that the MPT cover 613 is swingable about an axis O3 in the X direction. The MPT cover 613 engages a supporting hole 613*b* formed on a lower end of the main frame 607, and is supported so as to be swingable about the axis O3. Further, arms 609L and 609R as arm members are mounted to the main frame 607 so that the arms 609L and 609R are swingable about an axis O2 (FIG. 3). The arms 609L and 609R have cam pins 609*c* that engages cam grooves 613*c* formed on both sides of the MPT cover 613 in the X direction. With the arms 609L and 609R, the MPT cover 613 is supported by the main frame 607 in a suspension manner.

The MPT cover 613 is swingable between an upright position where the MPT cover 613 is retracted in a space inside the main frame 607 and a lying position where the MPT cover 613 protrudes outside from the main frame 607 as shown in FIG. 2. The MPT cover 613 swings together with the arms 609L and 609R. The MPT cover 613 has a lock lever 613*a* that engages an engaging portion (not shown) of the main frame 607 when the MPT cover 613 is in the upright position.

A sheet placing plate 604 as a medium placing member is mounted to the MPT 613 for placing the sheets 606. Supporting pins 604*a* are formed on both sides of the sheet placing plate 604 in the X direction. The supporting pins 604*a* engage guide grooves 613*d* formed on the MPT cover 613, with which the sheet placing plate 604 is swingable about the axis in the X direction. A swinging shaft 605 (FIG. 3) as a lifting unit abuts against the sheet placing plate 604 from below.

The swinging shaft 605 pushes the sheet placing plate 604 upward toward the pickup roller 602 using a driving force transmitted from a feeding motor 71 (FIG. 17) as a driving source via a driving force transmitting portion (i.e., a driving force transmitting mechanism) 612. A configuration of the driving force transmitting portion 612 will be described later. An upper surface of the sheet placing plate 604 (or a surface of the uppermost sheet 606 when the sheets 606 are placed on the sheet placing plate 604) contacts the pickup roller 602.

A pair of side guides 610L and 610R are mounted to the sheet placing plate 604 so that the side guides 610L and 610R are movable in the X direction. The side guides 610L and 610R define both ends of the sheet 606 in the widthwise direction. Further, in order to support a large sized sheet, a support guide 608*a* is reversibly mounted to the MPT cover 613, and a slidable support guide 608*b* is mounted to the support guide 608*a* so as to protrude from the support guide 608*a*.

The MPT 600 includes a feeding roller 601 and a retard roller 603 are provided at a downstream side (i.e. right in FIG. 3) thereof in a feeding direction of the sheet 606. The feeding roller 601 and the retard roller 603 face each other in the Z direction. The retard roller 603 is applied with a torque (i.e., a separation force) for separating the sheets 606. The retard roller 603 is supported by the retard frame 603*a* swingably mounted to the main frame 607, and is pressed against the feeding roller 601 by a spring 603*b*.

Figure 4:
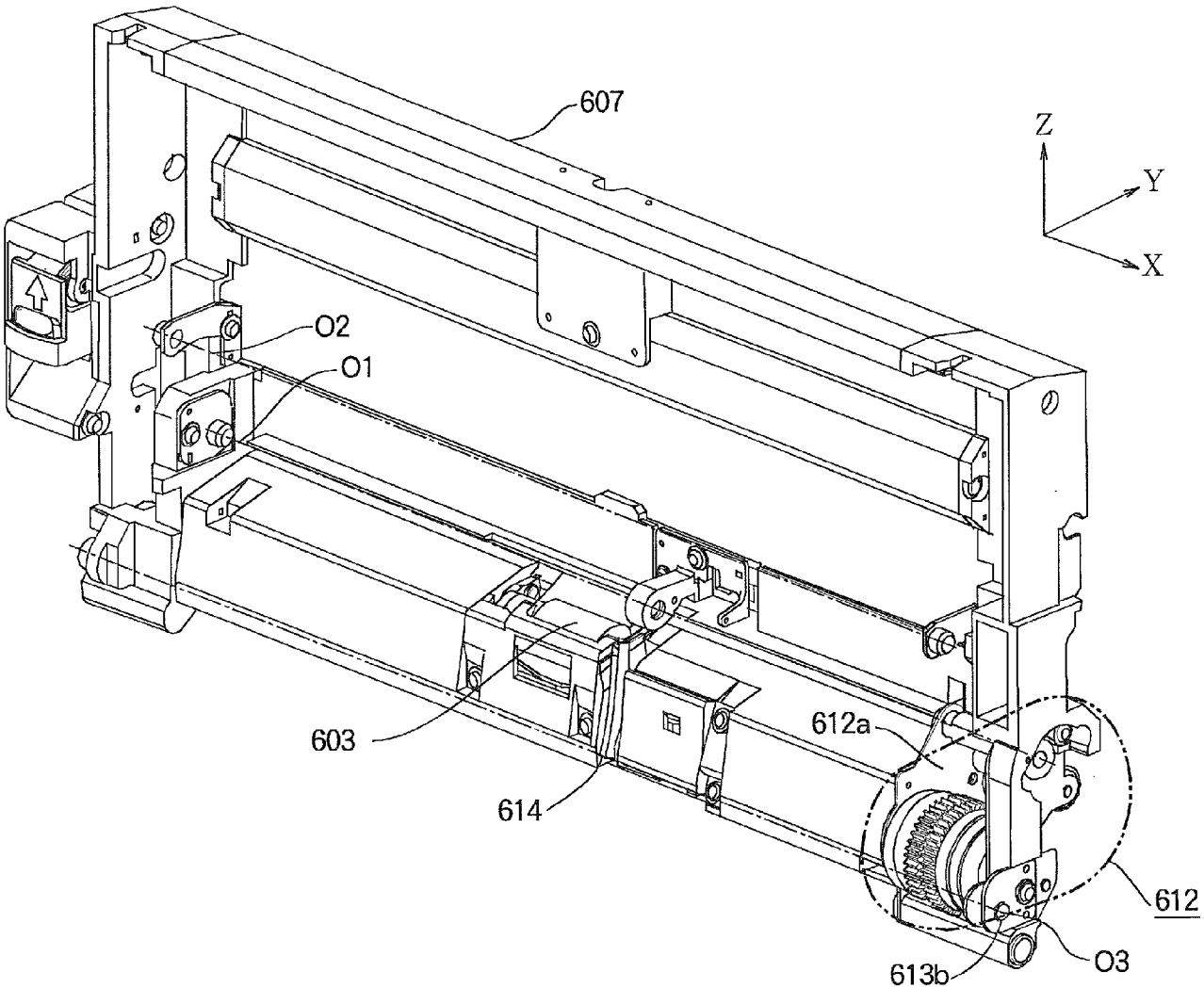
FIG. 4 is a perspective view showing a main frame of the MPT and components mounted on the main frame according to the first embodiment of the present invention.

FIG. 4 is a perspective view showing the main frame 607 and components mounted thereto. The retard roller 603 is mounted to the retard frame 603*a* (FIG. 3). A sheet sensor 614 as a medium detecting unit is provided in the vicinity of the retard roller 603. The sheet sensor 614 is used for determining presence or absence of the sheet 606 on the sheet placing plate 604. The sheet sensor 614 includes, for example, a lever member and a photo coupler.

Figures 5A, 5B, 5C:
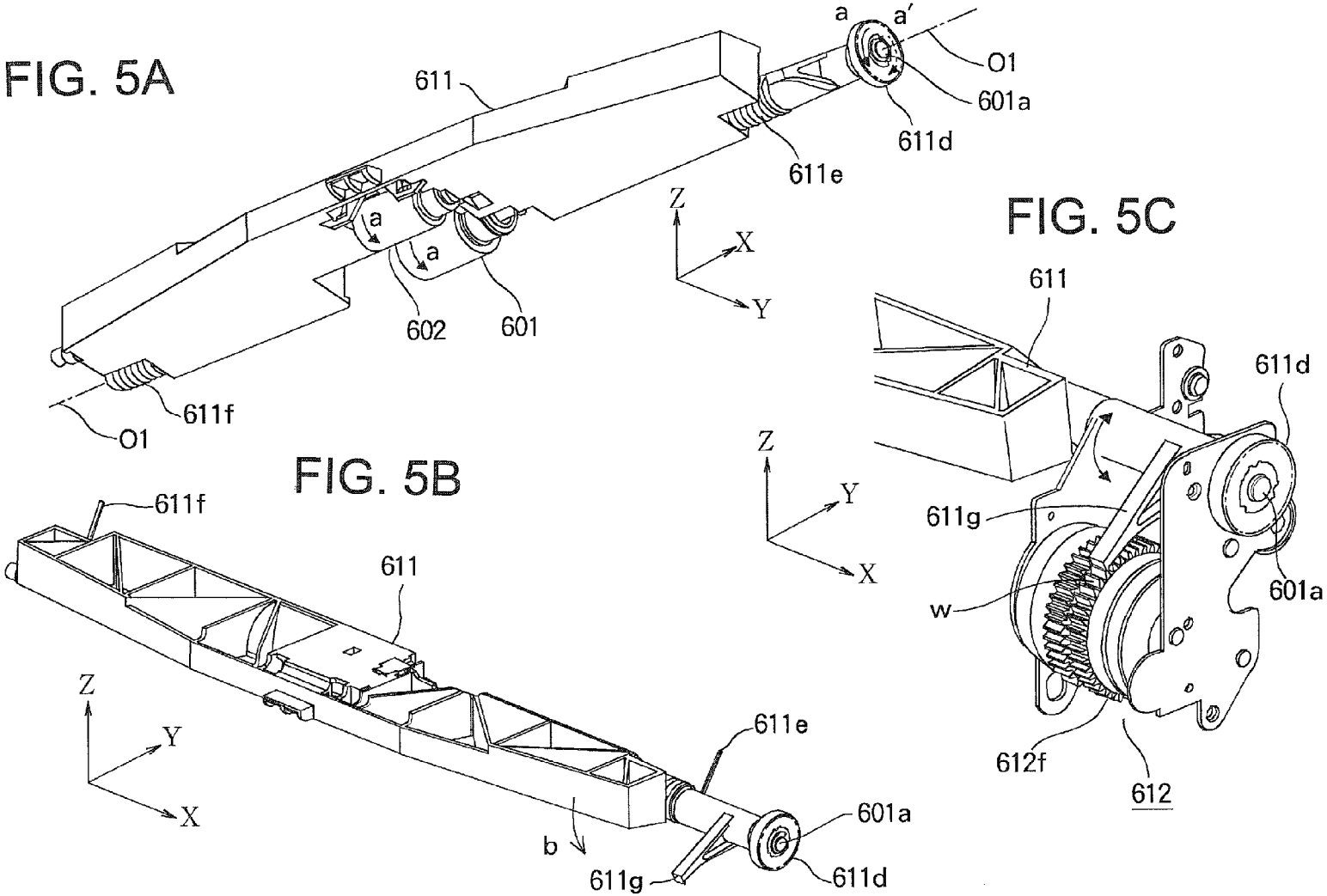
FIGS. 5A and 5B are top and bottom perspective views of a pickup frame of the MPT according to the first embodiment of the present invention.
FIG. 5C is an enlarged perspective view showing a part of the pickup frame shown in FIGS. 5A and 5B.

FIGS. 5A and 5B are respectively top and bottom perspective views showing the pickup frame 611. A shaft 601*a* of the feeding roller 601 and a shaft of the pickup roller 602 are rotatably supported by the pickup frame 611. A rotation axis of the shaft 601*a* of the feeding roller 601 is the above described axis O1.

A feeding driving gear 611*d* as a selective transmission unit is provided on an end of a shaft 601*a* of the feeding roller 601. The feeding driving gear 611*d* has a one-way clutch therein. When the feeding driving gear 611*d* rotates in a direction shown by an arrow "a" in FIG. 5A, the one-way clutch is locked, and the shaft 601*a* rotates in the direction shown by the arrow "a". Therefore, the feeding roller 601 rotates in the direction shown by the arrow "a". In contrast, when the feeding driving gear 611*d* rotates in a direction shown by an arrow a' in FIG. 5A, the one-way clutch rotates idly, and a rotation of the feeding driving gear 611*d* is not transmitted to the shaft 601*a*. Therefore, the feeding roller 610 does not rotate.

A rotation of the feeding roller 601 is transmitted to the pickup roller 602 via gears (not shown) provided in the pickup frame 611, so that the pickup roller 602 rotates in the same direction as the pickup roller 602. Therefore, when the feeding driving gear 611*d* rotates in the direction shown by the arrow "a" in FIG. 5A, the feeding roller 601 and the pickup roller 602 both rotate in the direction shown by the arrow "a" in FIG. 5A. In contrast, when the feeding driving gear 611*d* rotates in the direction shown by the arrow a' in FIG. 5A, the feeding roller 601 and the pickup roller 602 do not rotate.

As shown in FIG. 5B, torsion springs 611*e* and 611*f* are provided on both sides of the pickup frame 611. The torsion springs 611*e* and 611*f* biases the pickup frame 611 in a direction (shown by an arrow "b") in which the pickup roller 602 contacts the sheet 606. Each of the torsion springs 611*e* and 611*f* has an end that abuts against a predetermined part of the main frame 607 so that the torsion springs 611*e* and 611*f* bias the pickup frame 611.

FIG. 5C is an enlarged perspective view showing an end portion of the pickup frame 611 in the X direction. A claw portion 611*g* as a first switching unit is formed on an end portion of the pickup frame 611 on the feeding driving gear 611*d* side. The claw portion 611*g* of the pickup frame 611 engages ratchet claws w formed on an outer circumference of an elevating ratchet 612*f* (described later) of a driving force transmission portion 612. The claw portion 611*g* moves apart from the ratchet claws w of the elevating ratchet 612*f* when the pickup frame 611 moves upward together with the sheet placing plate 604 as will be described later.

Figure 6:
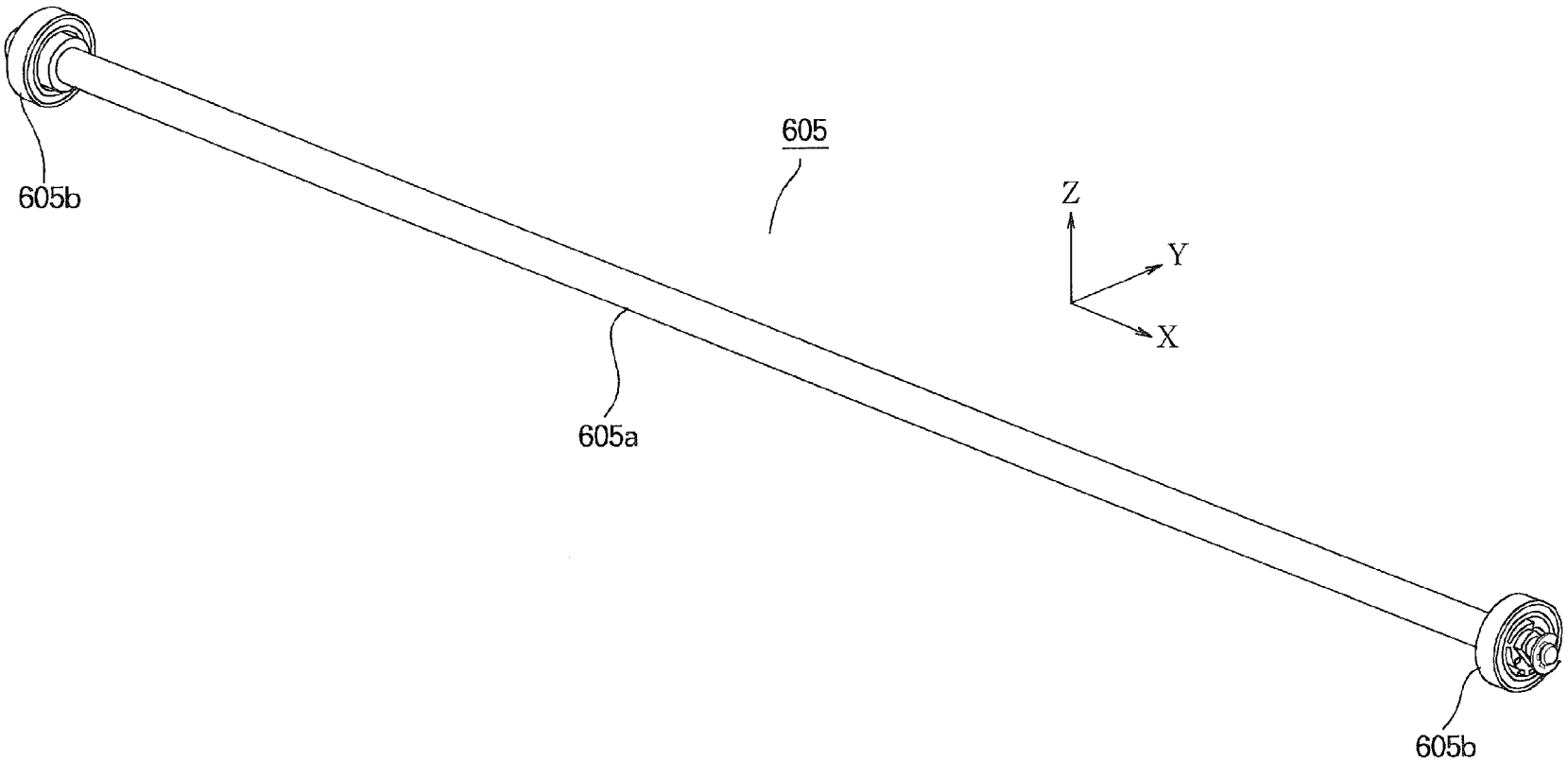
FIG. 6 is a perspective view showing a swinging shaft of the MPT according to the first embodiment of the present invention.
Figure 7:
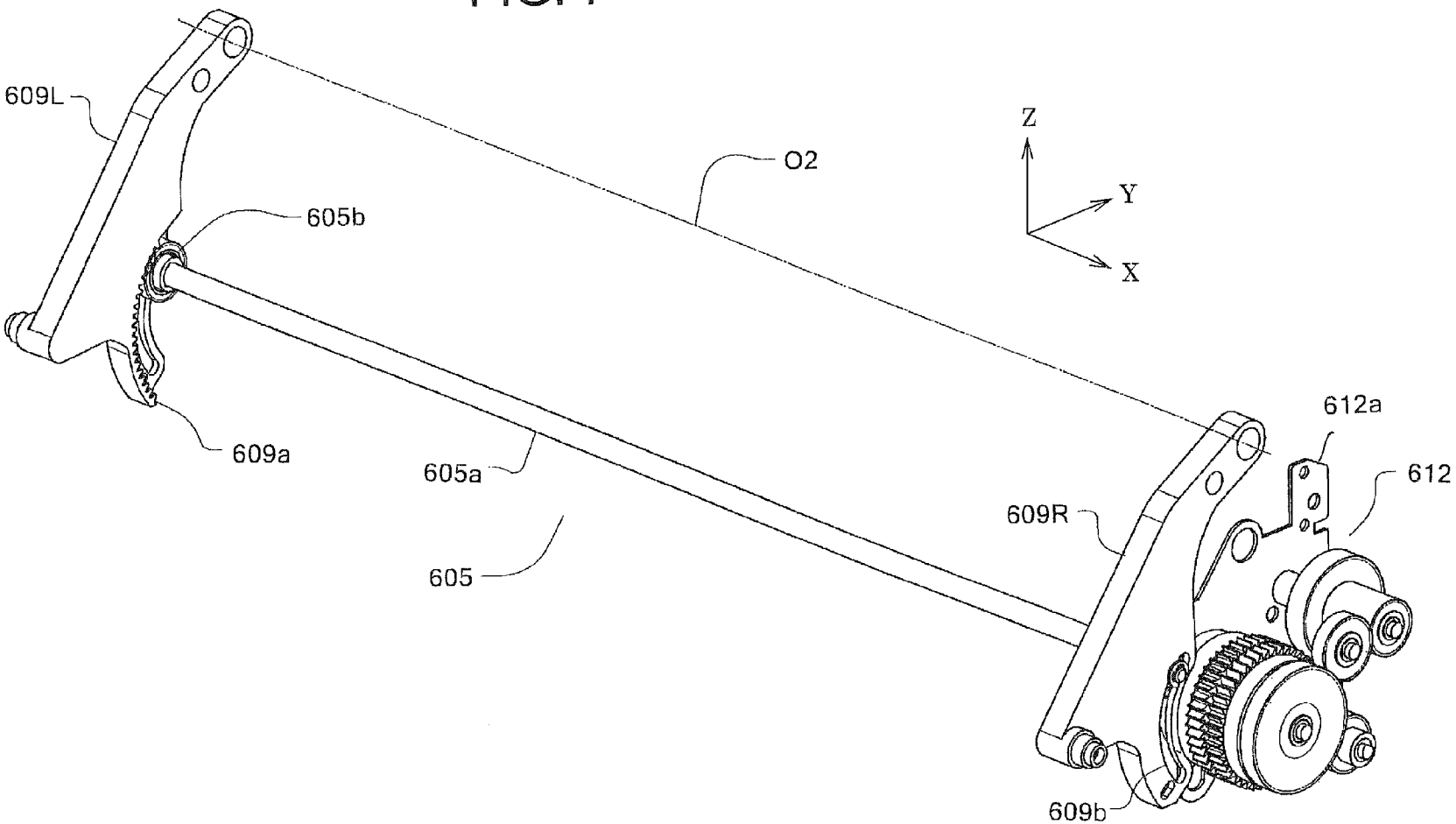
FIG. 7 is a perspective view showing the swinging shaft, an arm and a driving force transmission portion according to the first embodiment of the present invention.
Figure 8:
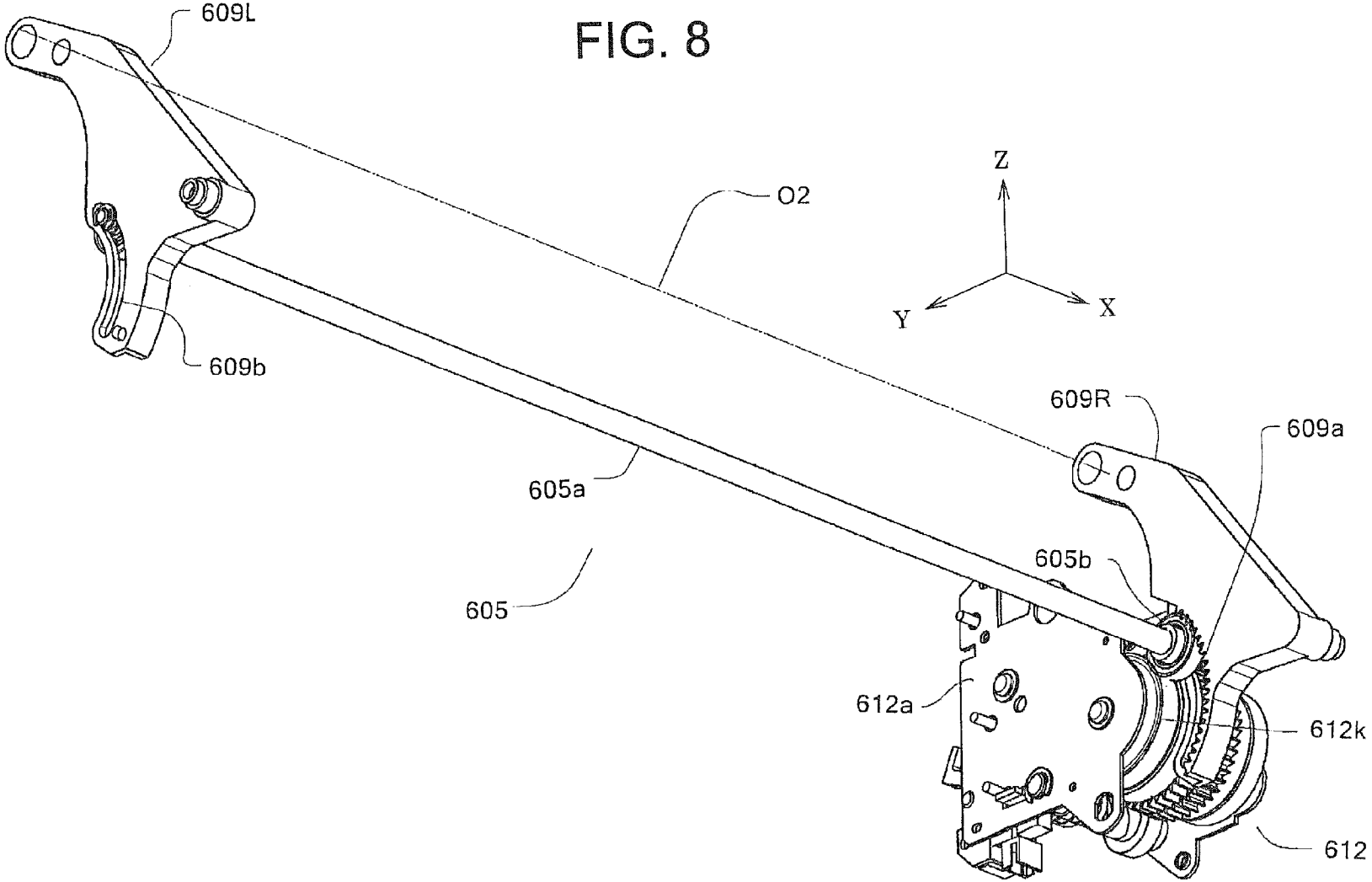
FIG. 8 is a perspective view showing the swinging shaft, the arm and the driving force transmission portion according to the first embodiment of the present invention.

FIG. 6 is a perspective view showing the swinging shaft 605. FIGS. 7 and 8 are perspective views showing the swinging shaft 605, the arms 609L and 609R and the driving force transmission portion 612. As shown in FIG. 6, the swinging shaft 605 includes a shaft 605*a* extending in the X direction along a bottom portion of the sheet placing plate 604, and a pair of gears 605*b* (i.e., planet gears) fixed to both ends of the shaft 605*a*. The gears 605*b* are fixed to the shaft 605*a* so that phases of the gears 605*b* match each other.

As shown in FIGS. 7 and 8, the arms 609L and 609R have arc-shaped guide holes (grooves) 609*b*. The arc-shaped guide holes 609*b* are formed in a concentric fashion with a lift-up gear 612*k* (described later) of the driving force transmitting portion 612. Both ends of the shaft 605*a* respectively engage the arc-shaped guide holes 609*b* of the arms 609L and 609R. With such a structure, a swinging of the swinging shaft 605 is guided.

Further, the arms 609L and 609R have internal tooth racks 609*a* as internal tooth portions. The internal tooth racks 609*a* are formed in a concentric fashion with the lift-up gear 612*k* (described later) of the driving force transmitting portion 612. The gears 605*b* fixed to both ends of the shaft 605*a* mesh with the internal tooth racks 609*a*. The gears 605*b* rotate and revolve while meshing with the lift-up gear 612*k* and the internal tooth racks 609*a*, with the result that the swinging shaft 605 moves (swings) substantially upward or downward along the guide holes 609*b*.

Figure 9B:
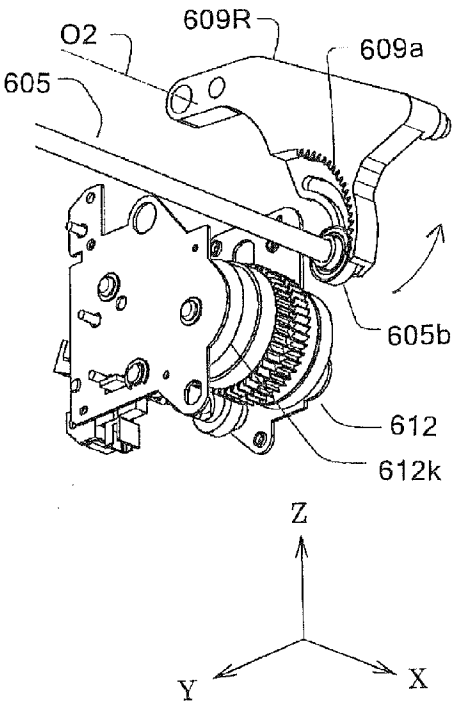
FIG. 9B is an enlarged perspective view showing a part of the main frame of the MPT and the MPT cover shown in FIG. 9A.
Figure 9A:
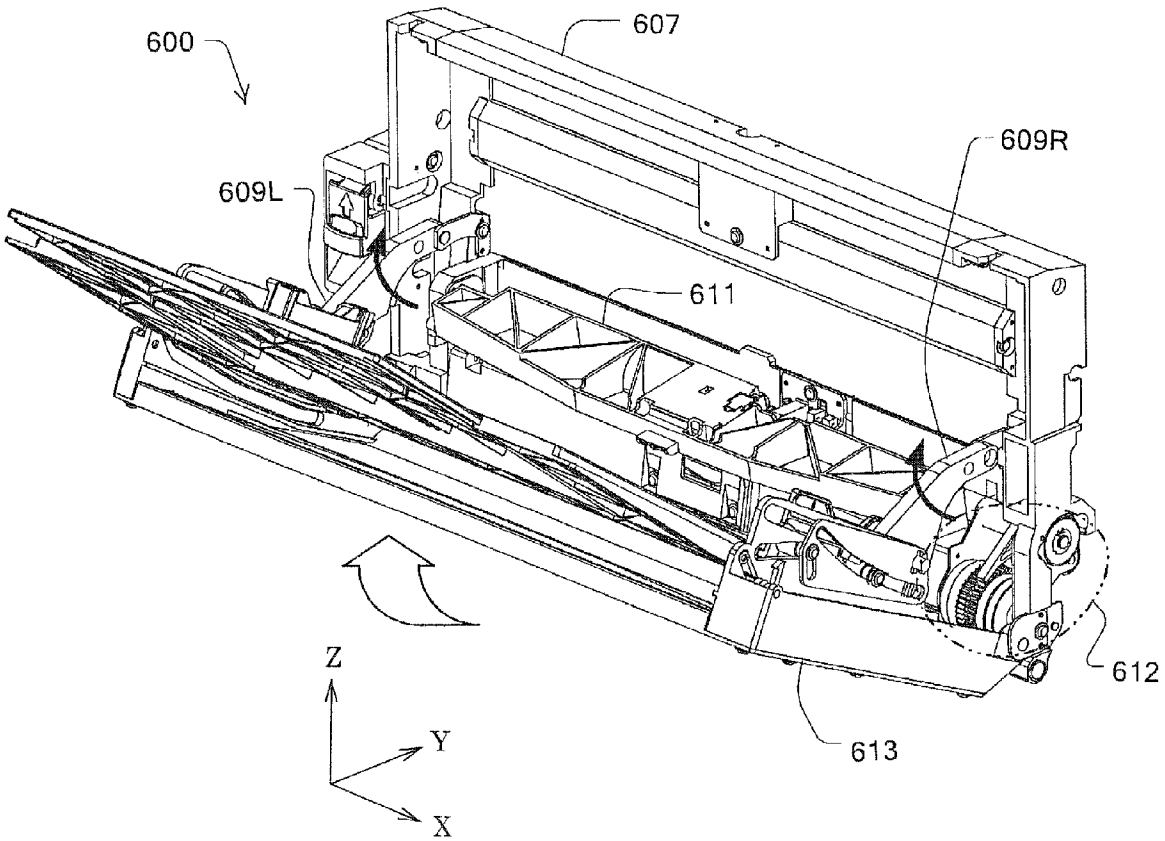
FIG. 9A is a perspective view showing the main frame of the MPT and an MPT cover according to the first embodiment of the present invention.

FIG. 9A is a perspective view showing the main frame 607 and the MPT cover 613. FIG. 9B is an enlarged view showing a part encircled by a dashed-two dotted line in FIG. 9A. The MPT cover 613 is swingable with respect to the main frame 607 as described above. When the MPT 600 is not used, the MPT cover 613 is swung to the upright position as shown by an arrow in FIG. 9A, and is retracted in the main frame 607. As the MPT cover 613 swings, the arms 609L and 609R also swing about the axis O2 (FIG. 3) in the same direction as the MPT cover 613. As the arms 609L and 609R swing, the swinging shaft 605 supported at the arc-shaped guide holes 609*b* of the arms 609L and 609R move apart from the lift-up gear 612*k* of the driving force transmission portion 612 as shown in FIG. 9B.

Figure 10B:
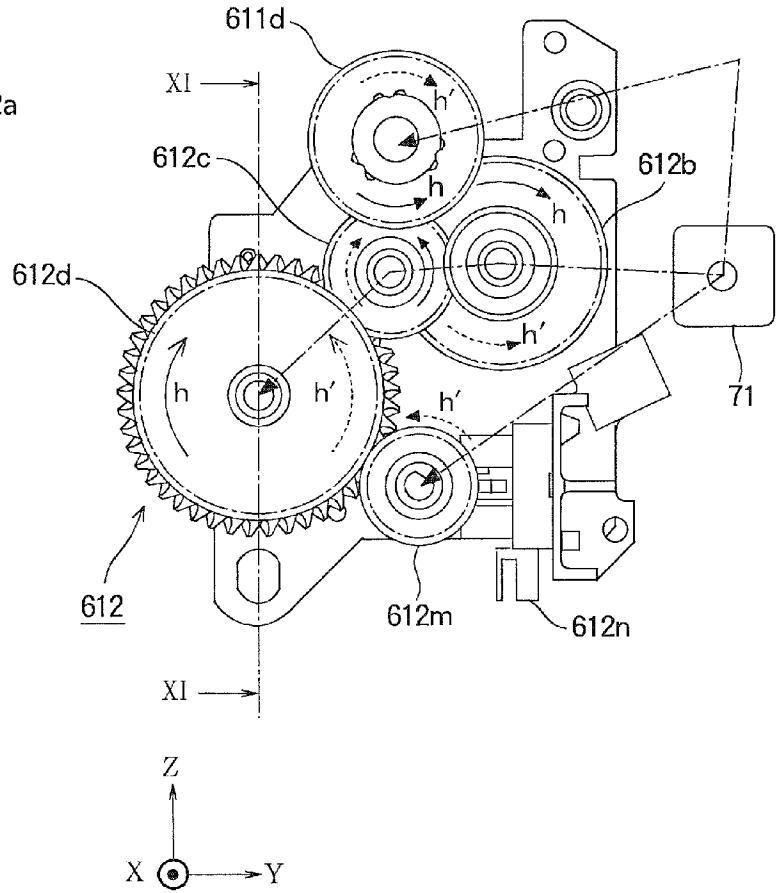
FIG. 10B is a schematic view showing a driving force transmission path of the driving force transmission portion shown in FIG. 10A.
Figure 10A:
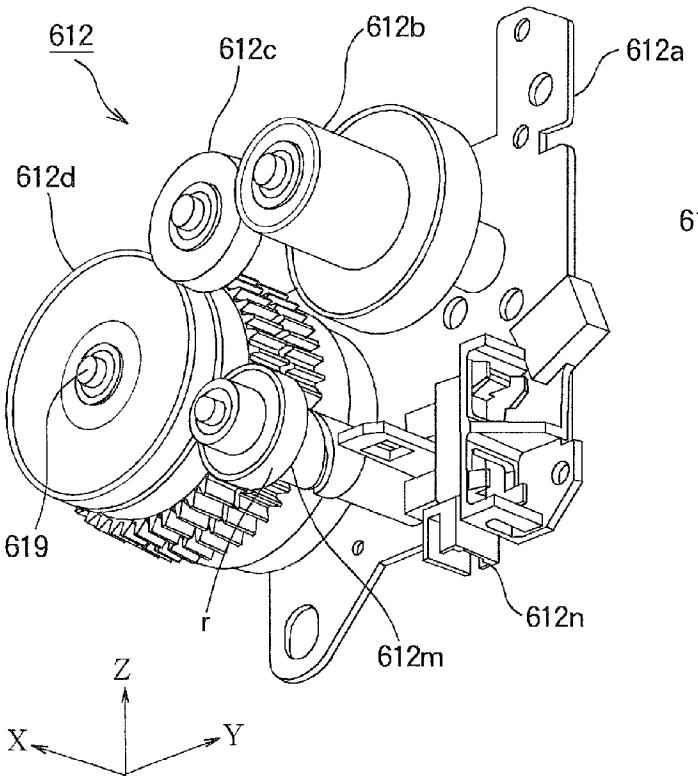
FIG. 10A is a perspective view showing the driving force transmission portion according to the first embodiment of the present invention.

FIG. 10A is a perspective view showing the driving force transmission portion 612. The driving force transmission portion 612 has a bracket 612*a* on an end in the X direction. The bracket 612*a* has a plurality of posts rotatably supporting the respective gears. The driving force transmission portion 612 has another bracket (not shown) on the other end in the X direction so as to face the bracket 612*a*. A reduction gear 612*b*, an idle gear 612*c*, a one-way gear 612*d*, and a cam gear 612*m* as a movable body and a photo coupler 612*n* as a detecting unit are mounted to the bracket 612*a*. These components will be described later.

FIG. 10B is a schematic view showing a driving force transmission path of the driving force transmission portion 612. For convenience of description, the feeding driving gear 611*d* (for transmitting the driving force to the feeding roller 601) is also shown in FIG. 10B. A rotation of the feeding motor 71 of the image forming apparatus 10 is transmitted to the reduction gear 612*b* via not shown gears. The reduction gear 612*b* meshes with the idle gear 612*c*. The idle gear 612*c* meshes with the one-way gear 612*d*. The rotation of the feeding motor 71 is also transmitted to the feeding driving gear 611*d* via not shown gears.

In FIG. 10B, arrows h (solid line) indicate rotating directions of the respective gears when the sheet 606 is being fed. When the feeding driving gear 611*d* rotates in the direction indicated by the arrow h, the one-way clutch of the feeding driving gear 611*d* is locked (that is, the one-way clutch transmits the rotation to the shaft 601*a*), and the feeding roller 601 and the pickup roller 602 rotate. Further, a one-way clutch mechanism provided between the one-way gear 612*d* and a driven gear 612*e* (described later) is locked, and the driving force is transmitted to the swinging shaft 605.

In FIG. 10B, arrows h' (dashed line) indicate rotating directions opposite to those shown by the arrows h. When the feeding driving gear 611*d* rotates in the direction shown by the arrow h', the one-way clutch of the feeding driving gear 611*d* rotates idly, and the feeding roller 601 and the pickup roller 602 do not rotate. Further, the one-way clutch mechanism provided in the one-way gear 612*d* (coupled with the driven gear 612*e*) rotates idly, and the driving force is not transmitted to the swinging shaft 605.

The rotation of the feeding motor 71 is also transmitted to the cam gear 612*m* via gears and a one-way clutch mechanism (not shown). In this regard, the cam gear 612*m* rotates only in the direction shown by the arrow h' by the action of the one-way clutch mechanism. Therefore, the cam gear 612*m* does not rotate while the sheet 606 is being fed.

Figure 11A:
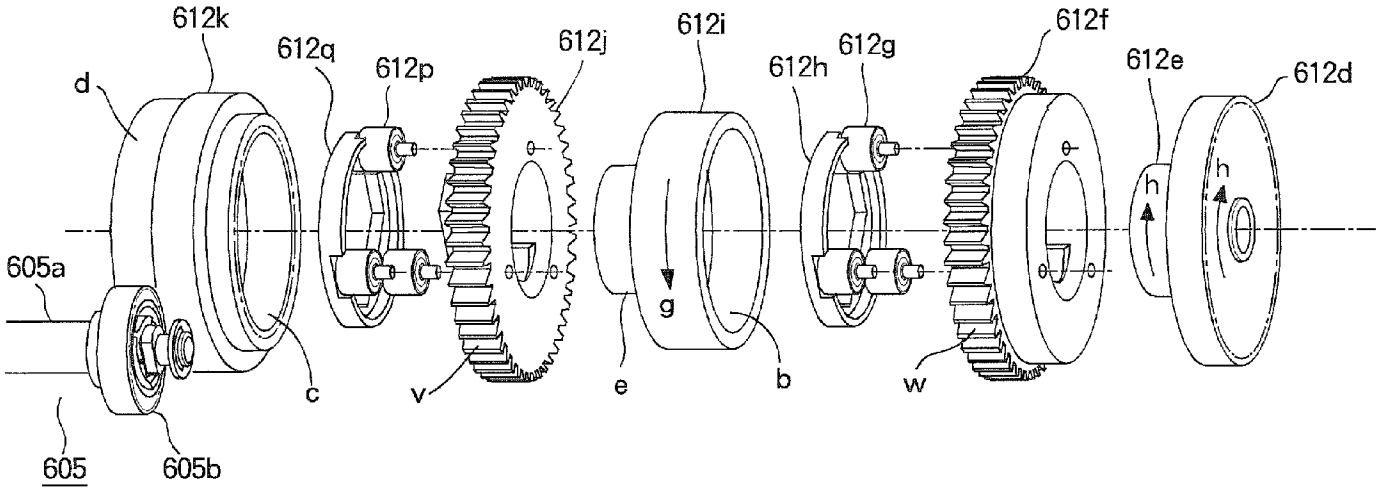
FIGS. 11A and 11B are an exploded perspective view and a sectional view showing a gear portion of the driving force transmission portion of the MPT according to the first embodiment of the present invention.
Figure 11B:
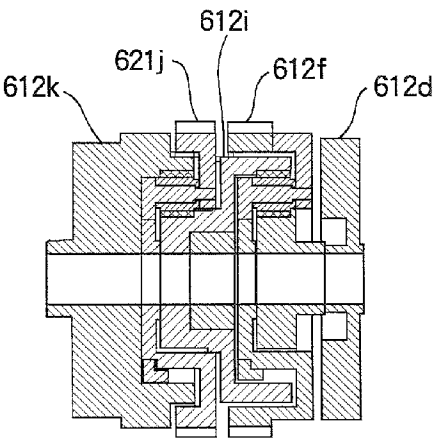

FIGS. 11A and 11B are respectively an exploded perspective view and a sectional view showing gears of the driving force transmission portion 612. As shown in FIG. 11A, the driving force transmission portion 612 includes the driven gear 612*e*, a elevating ratchet 612*f*, planet gears 612*g* (with a planet gear holder 612*h*), a lock gear 612*i*, a reset ratchet 612*j*, planet gears 612*p* (with a planet gear holder 612*q*) and a lift-up gear 612 which are coupled coaxially with the one-way gear 612*d* and are arranged along the X direction in this order from the one-way gear 612*d* side. These gears are supported by a common shaft 619 (FIG. 10A) omitted in FIG. 11A.

The driven gear 612*e* is provided adjacent to the one-way gear 612*d*. The one-way clutch mechanism is provided between the one-way gear 612*d* and the driven gear 612*e* so that the driven gear 612*e* follows the rotation of the one-way gear 612*d* only when the one-way gear 612*d* rotates in the direction shown by the arrow h. The driven gear 612*e* has an external tooth portion that meshes with the planet gears 612*g* as described later. The one-way gear 612*d* and the driven gear 612*e* constitute a sun gear (i.e., a third sun gear) having the one-way clutch mechanism.

Although a detailed description is omitted, the one-way clutch mechanism can be configured as, for example, a mechanism using a coil spring or a mechanism using a needle bearing. In the case where the one-way clutch mechanism uses a coil spring, when the one-way gear 612*d* rotates in the direction shown by the arrow h, the coil spring is wound tightly around shaft portions of the one-way gear 612*d* and the driven gear 612*e* so as to transmit the rotation to the driven gear 612*e*.

The elevating ratchet 612*f* has a ring shape, and has a plurality of ratchet claws w (i.e., a to-be-engaged portion) on an outer circumference thereof. The driven gear 612*e* is inserted into inside the elevating ratchet 612*f* from the one-way gear 612*d* side. Three planet gears 612*g* (i.e., third planet gears) are mounted inside the elevating ratchet 612*f* so that the planet gears 612*g* faces an outer circumference of the driven gear 612*e*. The planet gear holder 612*h* is mounted to the elevating ratchet 612*f*. The planet gear holder 612*h* has a ring shape, and rotatably holds the planet gears 612*g*. The planet gears 612*g* mesh with the external tooth portion of the drive gear 612*e* inserted into inside the elevating ratchet 612*f*. The elevating ratchet 612*f* and the planet gear holder 612*h* constitute a second carrier that holds the planet gears 612*g* so that the planet gears 612*g* are able to revolve around the external tooth portion of the driven gear 612*e* (i.e., the third sun gear).

The lock gear 612*i* as a second sun gear is constituted by two ring-shaped portions one of which has a larger diameter than the other. The ring-shaped portions (i.e., a larger portion and a smaller portion) are combined with each other in the X direction so that a larger portion is located on the one-way gear 612*d* side. An internal tooth portion b is formed on an inner circumference of the larger portion of the lock gear 612*i*. The internal tooth portion b meshes with the planet gears 612*g*. An external tooth portion e is formed on an outer circumference of the smaller portion of the lock gear 612*i*. The external tooth portion e meshes with the planet gears 612*p*. Further, the lock gear 612*i* is fixed to the shaft 619 (FIG. 10A) inserted inside the lock gear 612*i* via a one-way clutch mechanism that rotates only in a direction shown by an arrow g. The shaft 619 is fixed to the bracket 612*a* (FIG. 10A) and does not rotate. Therefore, the lock gear 612*i* rotates only in the direction shown by the arrow g.

The reset ratchet 612*j* has a ring shape, and has a plurality of ratchet claws v (i.e., a to-be-engaged portion) on an outer circumference thereof. The smaller portion of the lock gear 612*i* is inserted inside the reset ratchet 612*j*.

Three planet gears 612*p* as second planet gears are rotatably supported by the planet gear holder 612*q*. The planet gear holder 612*q* is fixed to the reset ratchet 612*j*. The planet gears 612*p* mesh with the external tooth portion e of the smaller portion of the lock gear 612*i* (inserted inside the reset ratchet 612*j*). The reset ratchet 612*j* and the planet gear holder 612*q* constitute a first carrier that holds the planet gears 612*p* so that the planet gears 612*p* are able to revolve around the external tooth portion e of the lock gear 612*i* (i.e., the second sun gear).

The lift-up gear 612*k* as a first sun gear has an internal tooth portion c on an inner circumference on the one-way gear 612*d* side. The internal tooth portion c mesh with the planet gears 612*p*. The lift-up gear 612*k* has an external tooth portion d that mesh with one of the gear 605*b* (i.e., first planet gears) mounted on the swinging shaft 605.

In this example, three planet gears 612*g* and three planet gears 612*p* are provided. However, the number of the planet gears 612*g* and 612*p* can be more than three, or less than three as long as the planet gears 612*g* and 612*p* can transmit the driving force.

Figure 12A:
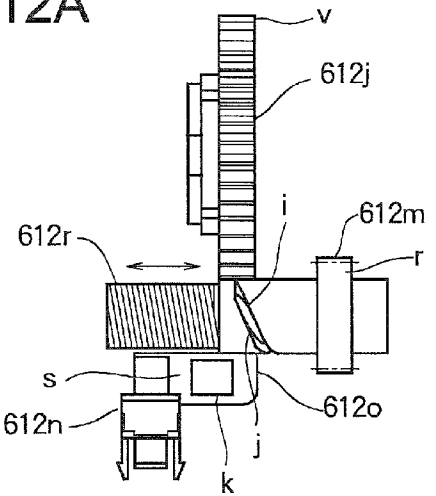
FIGS. 12A and 12B are a plan view and a perspective view showing a state where a reset ratchet of the MPT is locked by a cam gear according to the first embodiment of the present invention.
Figure 12B:
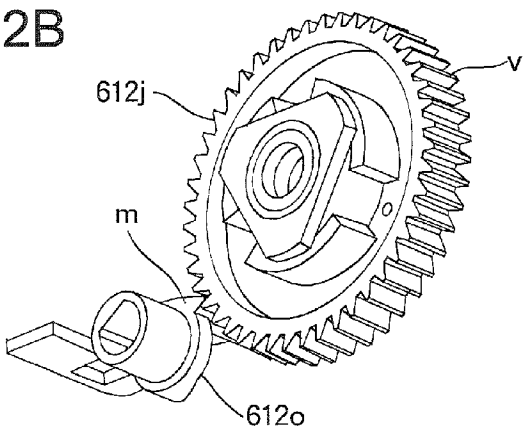

FIGS. 12A and 12B are a front view and a perspective view showing a mechanism for locking a rotation of the reset ratchet 612*j*. The above described cam gear 612*m* has an axial direction in the X direction, and has a cam portion i which is adjacent to the reset ratchet 612*j*. Further, the cam gear 612*m* has an external tooth portion r that meshes with a gear (not shown) with which the rotation of the feeding motor 71 (in the direction shown by the arrow h' in FIG. 10B) is transmitted to the cam gear 612*m*.

A lock piece 612*o* as a second switching unit is provided adjacent to the cam gear 612*m* so that the lock piece 612*o* is movable in the X direction. The lock piece 612*o* has a cam portion j that engages the cam portion i of the cam gear 612*m*. The lock piece 612*o* has a claw portion m (i.e., a to-be-engaged portion) that engages the ratchet claws v on the outer circumference of the reset ratchet 612*j*. When the cam gear 612*m* rotates, the lock piece 612*o* moves in the X direction, the claw portion m of the lock piece 612*o* engages (or disengages from) the ratchet claws v of the reset ratchet 612*j*.

In order to detect a position of the lock piece 612*o* in the X direction, a photo coupler 612*n* is provided adjacent to the lock piece 612*o*. The lock piece 612*o* has a light shielding plate s having a window k. When the light shielding plate s of the lock piece 612*o* blocks a light path of the photo coupler 612*n*, the photo coupler 612*n* outputs HIGH signal. When the window k of the lock piece 612*o* is in the light path of the photo coupler 612*n*, the photo coupler 612*n* outputs Low signal. The lock piece 612*o* is biased by a spring 612*r* in the X direction toward the cam gear 612*m*.

In a state shown in FIGS. 12A and 12B, the claw portion m of the lock piece 612*o* engages the ratchet claw v of the reset ratchet 612*j*, so as to lock the rotation of the reset ratchet 612*j*. In this state, the light shielding plate s of the lock piece 612*o* blocks the light path of the photo coupler 612*n*, and therefore the photo coupler 612*n* outputs HIGH signal.

Figure 12C:
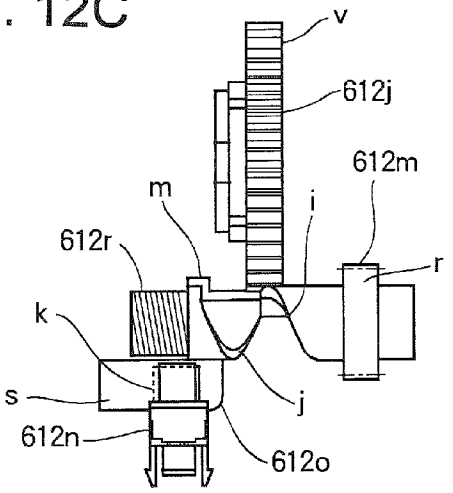
FIGS. 12C and 12D are a plan view and a perspective view showing a state where the reset ratchet of the MPT is not locked by the cam gear according to the first embodiment of the present invention.
Figure 12D:
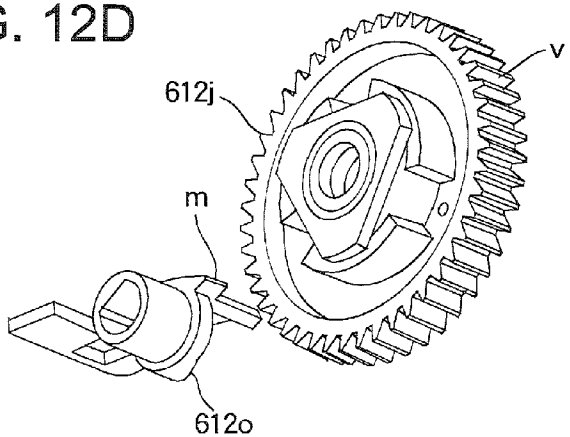

When the cam gear 612*m* rotates from the state shown in FIGS. 12A and 12B, the lock piece 612*o* is pushed so as to compress the spring 612*r*. Further, as shown in FIGS. 12C and 12D, the claw portion m of the lock piece 612*o* moves apart from the ratchet claw v of the reset ratchet 612*j*. Therefore, a locking on the rotation of the reset ratchet 612*j* is released, and, the reset ratchet 612*j* becomes rotatable. In this state, the window k of the lock piece 612*o* is in the light path of the photo coupler 612*n*, and therefore the photo coupler 612*n* outputs LOW signal.

Figure 13:
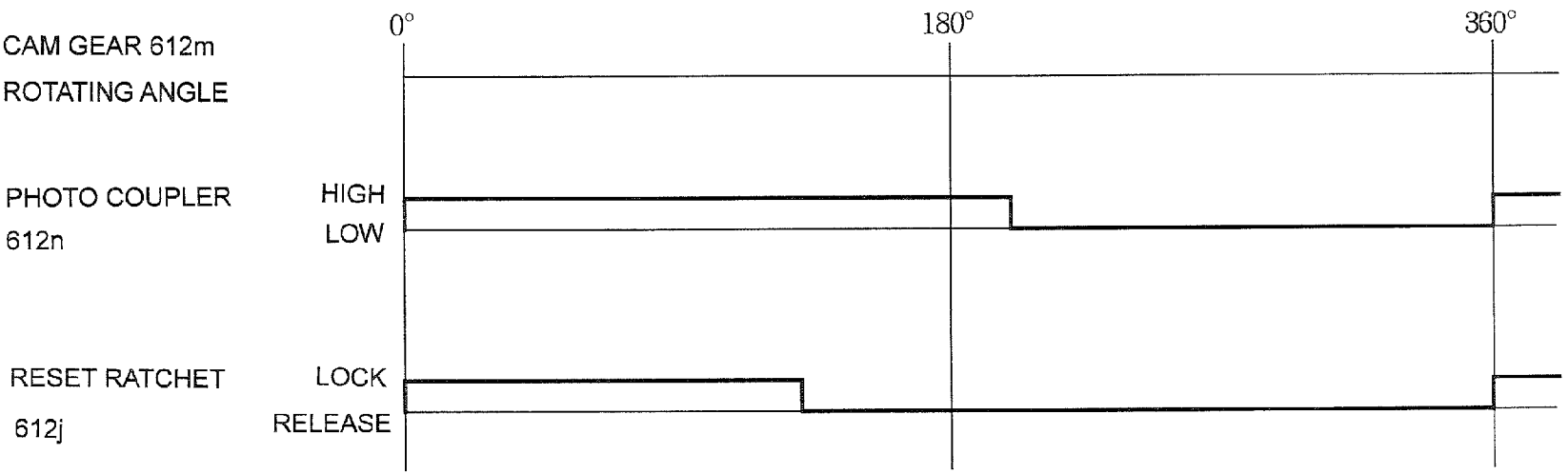
FIG. 13 is a timing chart showing an example of a rotation angle of the cam gear of the MPT and an output from a photo coupler according to the first embodiment of the present invention.

FIG. 13 is a timing chart showing a relationship between a rotating angle of the cam gear 612*m*, output from the photo coupler 612*n* (HIGH/LOW), and a locking state of the reset ratchet 612*j*. In this regard, the timing chart of FIG. 13 is merely an example, and this embodiment is not limited to the timing chart of FIG. 13.

As shown in FIG. 13, when the rotating angle of the cam gear 612*m* is in a predetermined range (for example, from 0 to 130 degrees), the claw portion m of the lock piece 612*o* engages the ratchet claws v of the reset ratchet 612*j*, and lock the rotation of the reset ratchet 612*j*. When the rotating angle of the cam gear 612*m* is in another predetermined range (for example, from 130 to 360 degrees), the claw portion m of the lock piece 612*o* moves apart from the ratchet claws v of the reset ratchet 612*j*, and allows the rotation of the reset ratchet 612*j*.

Figure 14A:
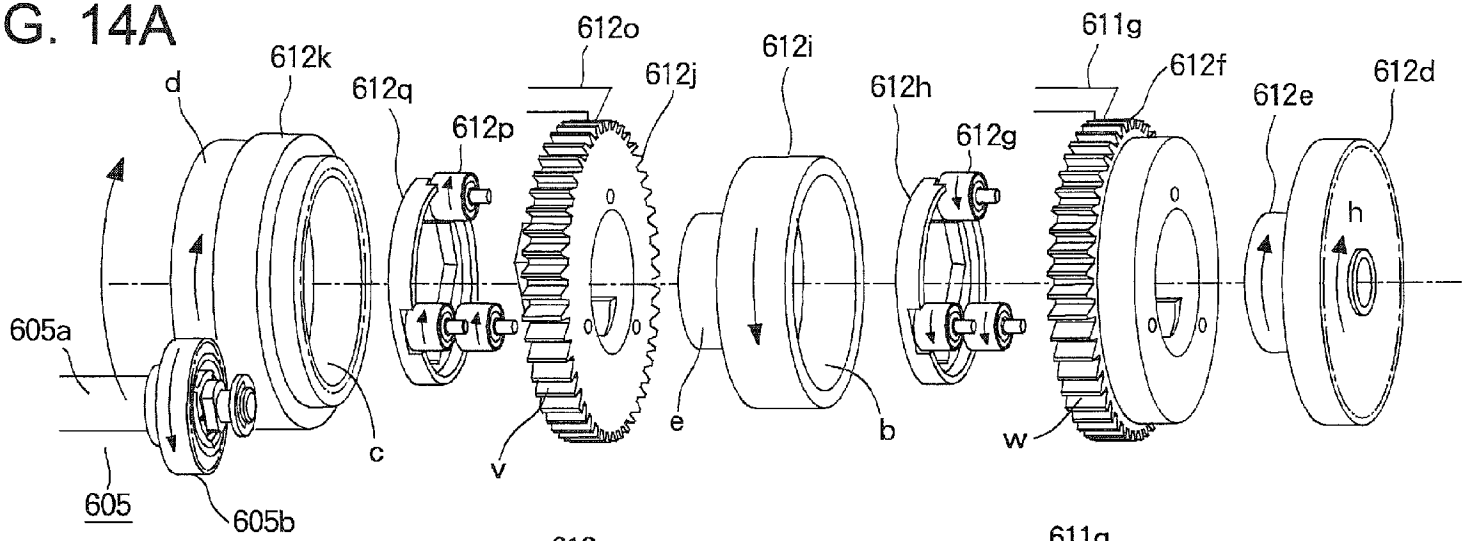
FIGS. 14A and 14B are exploded perspective views showing driving force transmission states of the driving force transmission portion of the MPT according to the first embodiment of the present invention.
Figure 14B:
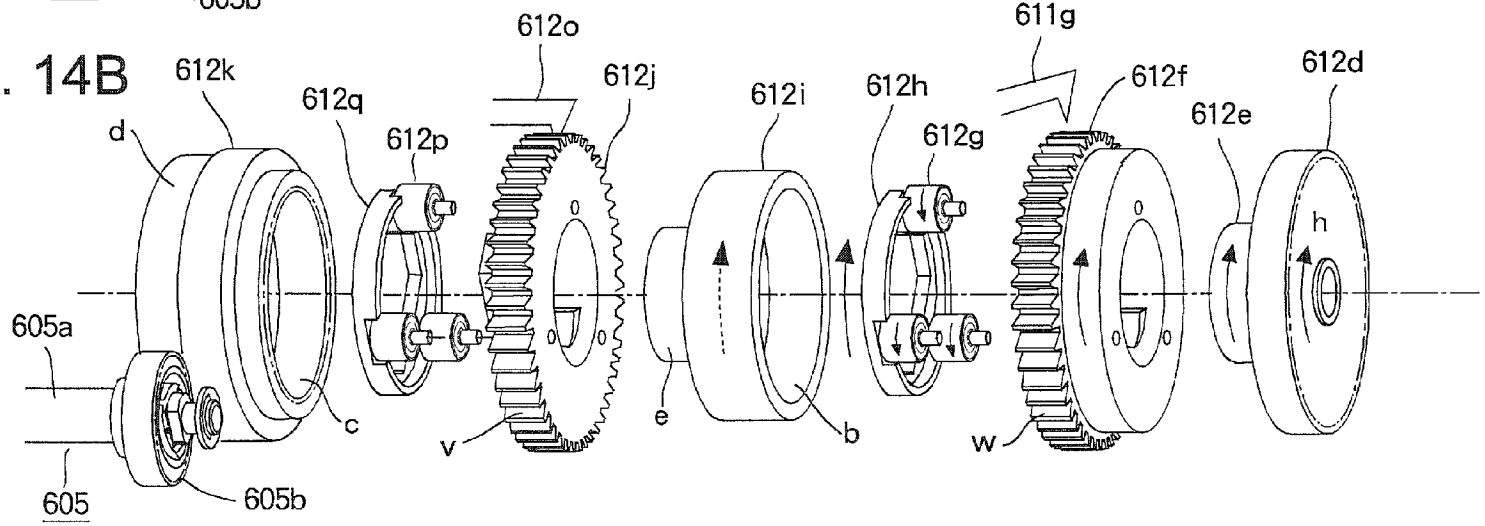
Figure 15:
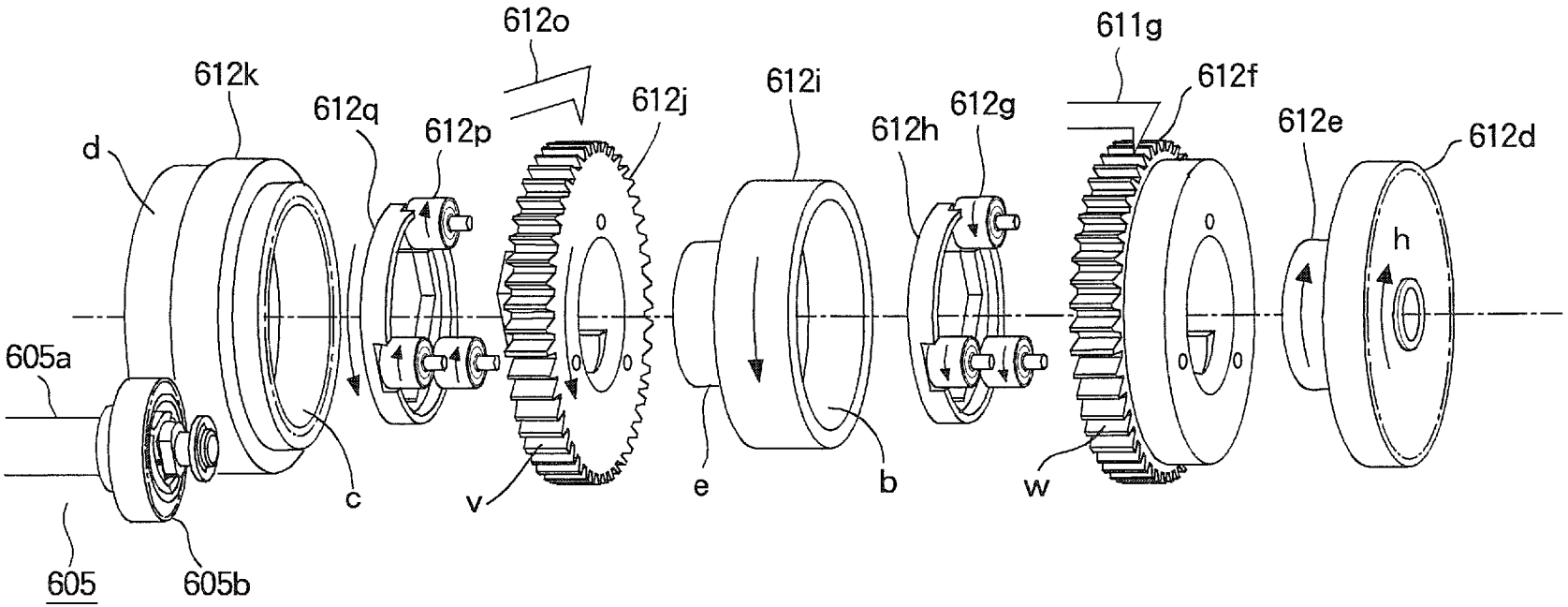
FIG. 15 is an exploded perspective view showing a driving force transmission state of the driving force transmission portion of the MPT according to the first embodiment of the present invention.

FIGS. 14A, 14B and 15 are exploded perspective views showing driving force transmission states at respective parts of the driving force transmission portion 612. FIG. 14A shows a state where the lock piece 612*o* engages the reset ratchet 612*j* to lock the rotation of the reset ratchet 612*j*, and the claw portion 611*g* of the pickup frame 611 engages the ratchet claws w of the elevating ratchet 612*f* to lock the rotation of the elevating ratchet 612*f*. In FIGS. 14A, 14B, 15A and 15B, lock piece 612*o* and the claw portion 611*g* of the pickup frame 611 are illustrated with simplified shapes.

In a state shown in FIG. 14A, when the one-way gear 612*h* rotates in the direction shown by the arrow h, the driven gear 612*e* rotates in the direction shown by the arrow h by the action of the one-way clutch mechanism between the one-way gear 612*d* and the driven gear 612*e*. The rotation of the elevating ratchet 612*f* is locked by the claw portion 611*g* of the pickup frame 611, and therefore the planet gears 612*g* (mounted to the elevating ratchet 612*f* via the planet gear holder 612*h*) do not revolve, but respectively rotate in a direction shown by arrows. As the planet gears 612*g* rotate, the lock gear 612*i* (having the internal tooth portion b that meshes with the planet gears 612*g*) rotates as shown by an arrow.

In this state, the rotation of the reset ratchet 612*j* is locked by the lock piece 612*o*, and therefore the planet gears 612*p* (that mesh with the external tooth portion e of the lock gear 612*i*) do not rotate, but respectively rotate in a direction shown by arrows. Therefore, the lift-up gear 612*k* (having the internal tooth portion c that meshes with the planet gears 612*p*) rotes as shown by an arrow. The gear 605*b* of the swinging shaft 605 meshes with the external tooth portion d of the lift-up gear 612*k*, and also meshes with the internal tooth rack 609*a* of the arm 609R. Therefore, as the lift-up gear 612*k* rotates, the gear 605*b* of the swinging shaft 605 rotates in a direction shown by an arrow, and also revolves around the lift-up gear 612*k* in an opposite direction. As a result, the swinging shaft 605 moves upward, and pushes the sheet placing plate 604 upward.

FIG. 14B shows a state where the lock piece 612*o* engages the reset ratchet 612*j* to lock the rotation of the reset ratchet 612*j*, and the claw portion 611*g* of the pickup frame 611 is apart from the elevating ratchet 612*f* to release the locking on the rotation of the elevating ratchet 612*f*.

In a state shown in FIG. 14B, when the one-way gear 612*d* rotates in the direction shown by the arrow h, the driven gear

612*e* also rotates in the direction shown by the arrow h, and the planet gears 612*g* rotate in the direction shown by arrows. The locking on the rotation of the elevating ratchet 612*f* is released, and therefore the planet gears 612*g* (mounted to the elevating ratchet 612*f* via the planet gear holder 612*h*) are rotatable and revolvable. Further, the lock gear 612*i* (having the internal tooth portion b that meshes with the planet gears 612*g*) does not rotate in a direction shown by a dashed arrow by the action of the one-way clutch mechanism. Therefore, the planet gears 612*g* respectively rotate in a direction shown by arrows and revolve in an opposite direction, so that the elevating ratchet 612*f* rotates in the same direction as the revolving direction of the planet gears 612. In this state, the lock gear 612*i* does not rotate, and therefore the planet gears 612*p* and the lift-up gear 612*k* do not rotate. Therefore, the swinging shaft 605 does not move.

FIG. 15 is a state where the lock piece 612*o* moves apart from the reset ratchet 612*j* to release the locking on the rotation of the reset ratchet 612*j*, and the claw portion 611*g* of the pickup frame 611 engages the elevating ratchet 612*f* to lock the rotation of the elevating ratchet 612*f*. When the one-way gear 612*d* rotates in the direction shown by the arrow h, the driven gear 612*e* also rotates in the direction shown by the arrow h. Since the rotation of the elevating ratchet 612*f* is locked, the planet gears 612*g* (mounted to the elevating ratchet f via the planet gear holder 612*h*) do not revolve, but respectively rotate in a direction shown by arrows. As the planet gears 612*g* rotate, the lock gear 612*i* (having the internal tooth portion b that meshes with the planet gears 612*g*) rotates in the same direction as the rotating direction of the planet gears 612*g*. As the lock gear 612*i* rotates, the planet gears 612*p* (that mesh with the external tooth portion e of the lock gear 612*i*) respectively rotate in a direction shown by arrows. In this regard, since the locking on the rotation of the reset ratchet 612*j* is released, a torque required for rotating the planet gears 612*p* is smaller than a load (torque) applied to the lift-up gear 612*k* that meshes with gear 605*b* of the swinging shaft 605. Therefore, the planet gears 612*p* respectively rotate in a direction shown by arrows, and revolve in an opposite direction. As a result, the lift-up gear 612*k* does not rotate, and the swinging shaft 605 does not move.

Figure 16A:
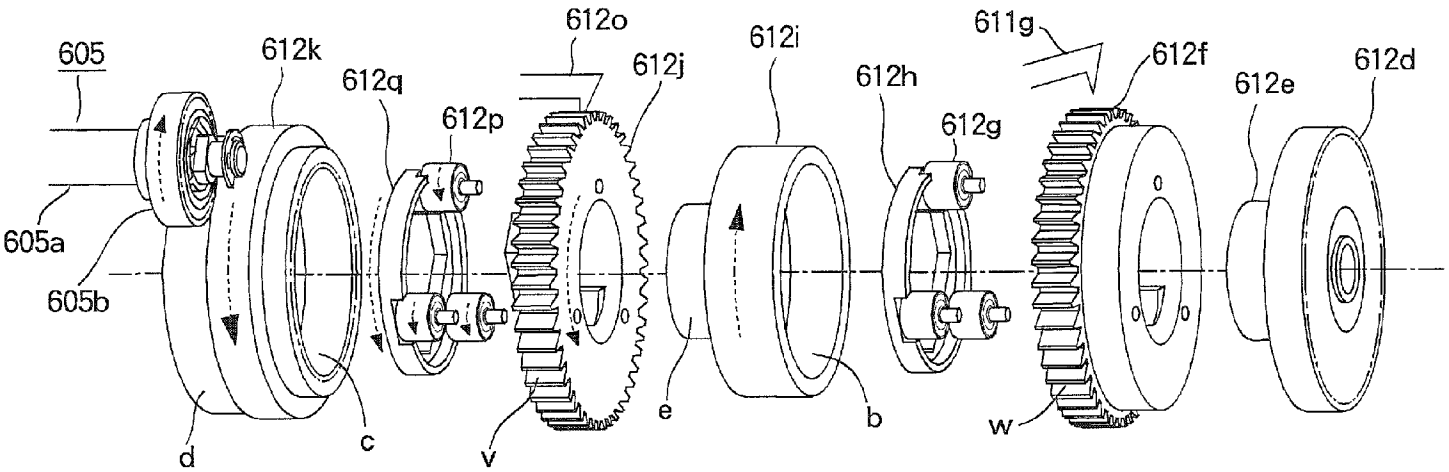
FIGS. 16A and 16B are exploded perspective views showing driving force transmission states of the driving force transmission portion of the MPT according to the first embodiment of the present invention.
Figure 16B:
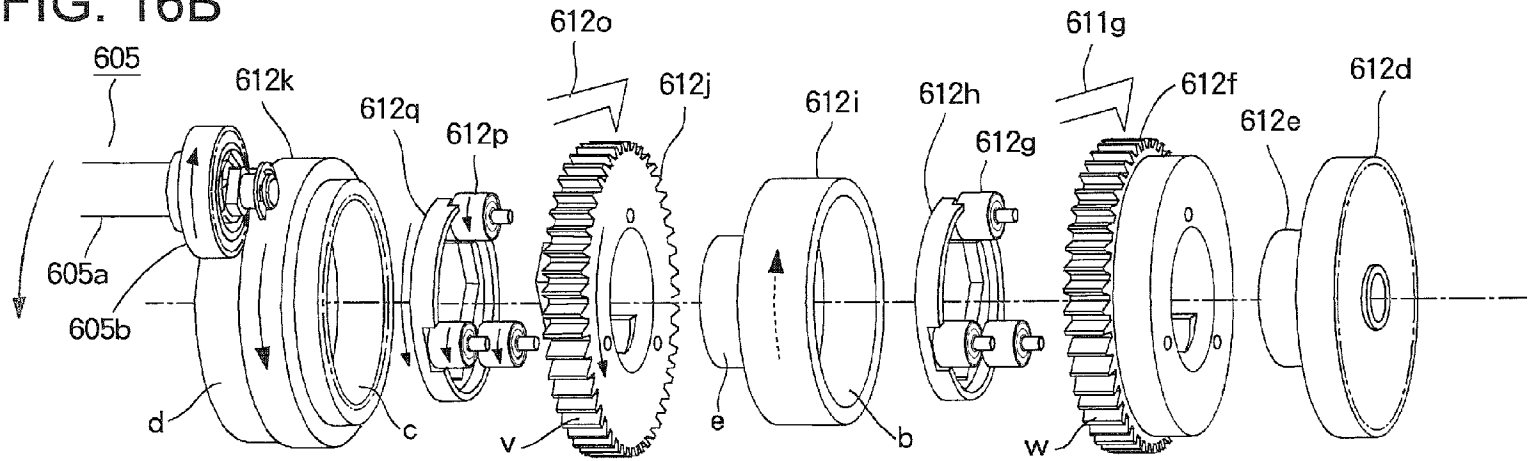

FIGS. 16A and 16B are exploded perspective views showing a state where the swinging shaft 605 is in an uppermost position (including a case where sheets 606 are placed on the sheet placing plate 604), and the one-way gear 612*d* does not rotate.

FIG. 16A shows a state where the lock piece 612*o* engages the reset ratchet 612*j* to lock the rotation of the reset ratchet 612*j*, and the claw portion 611*g* of the pickup frame 611 is apart from the elevating ratchet 612*f* to release the locking on the rotation of the elevating ratchet 612*f*. In this state, a downward force is applied to the swinging shaft 605, due to a total weight of the swinging shaft 605, the sheet placing plate 604 (omitted in FIG. 16A) and the sheets 606 placed on the sheet placing plate 604. Therefore, a torque (in a direction to cause the swinging shaft 605 to move downward) is applied to the gear 605*b*, the lift-up gear 612*k*, the planet gears 612*p*, the planet gear holder 612*q*, the reset ratchet 612*j* and the lock gear 612*i* respectively in directions shown by dashed arrows. In this regard, the rotation of the reset ratchet 612*j* is locked by the lock piece 612*o* (and therefore the revolving of the planet gears 612*p* is also locked), and the lock gear 612*i* does not rotate in the direction shown by the dashed arrow by the action of the one-way clutch mechanism. Therefore, the planet gears 612*p* (that mesh with the external tooth portion e of the lock gear 612*i*) do not rotate and do not revolve. Thus, the lift-up gear 612*k* (having the internal tooth portion c that meshes with the planet gears 612*p*) does not rotate. As a result, the swinging shaft 605 does not move downward.

The same can be said for the case where the rotation of the elevating ratchet 612*f* is locked by the claw portion 611*g* of the pickup frame 611.

FIG. 16B shows a state where the lock piece 612*o* moves apart from the reset ratchet 612*j* to release the locking on the rotation of the reset ratchet 612*j*, and the claw portion 611*g* of the pickup frame 611 is apart from the elevating ratchet 612*f* to release the locking on the rotation of the elevating ratchet 612*f*. In this state, a downward force is applied to the swinging shaft 605, due to a total weight of the swinging shaft 605, the sheet placing plate 604 (omitted in FIG. 16B) and the sheets 606 placed on the sheet placing plate 604. Therefore, a torque (in a direction to cause the swinging shaft 605 to move downward) is applied to the gear 605*b*, the lift-up gear 612*k*, the planet gears 612*p*, the planet gear holder 612*q*, the reset ratchet 612*j* and the lock gear 612*i* respectively in directions shown by dashed arrows. In this regard, the lock gear 612*i* does not rotate in the direction shown by the dashed arrow by the action of the one-way clutch mechanism, but the reset ratchet 612*j* is rotatable. Therefore, the planet gears 612*p* (that mesh with the external tooth portion e of the lock gear 612*i*) rotate and revolve. Thus, the lift-up gear 612*k* (having the internal tooth portion c that meshes with the planet gears 612*p*) rotates in the same direction as the planet gears 612*p*, and the swinging shaft 605 moves downward. The same can be said for the case where the rotation of the elevating ratchet 612*f* is locked by the claw portion 611*g* of the pickup frame 611.

FIG. 17 is a block diagram showing a control system of the image forming apparatus 10. The control system of the image forming apparatus 10 will be described with reference to FIGS. 1 and 17.

In FIG. 17, the control unit 62 of the image forming apparatus 10 includes, for example, a microprocessor, an ROM, an RAM, an IO port, a timer or the like. The control unit 62 receives printing data and control command from a not shown host device, and performs a whole printing operation of the image forming apparatus 10.

The control unit 62 receives various kinds of signals from an operation unit 63 and sensors 64. The operation unit 63 has a display panel 63*b* for displaying a condition of the image forming apparatus 10, an operation key 63*a* operated by an operator for inputting instructions, and the like. The sensors 64 for monitoring operating conditions of the image forming apparatus 10 include sheet sensors 301, 303 and 506 for detecting the positions of the sheet along the conveying path, a writing sensor 305, a temperature/humidity sensor, a density sensor, a slackening sensor, the sheet remaining amount detecting sensor 205, the upward movement detecting unit 201, a photo coupler 612*n* and the like.

The control unit 62 controls the image forming control unit 66, the feeding-and-conveying control unit 67, the belt driving control unit 69 and the fixing control unit 70.

The image forming control unit 66 controls operations of respective parts of the image forming portion 400 based on instruction from the control unit 62. For example, the image forming control unit 66 controls the rotations of the photosensitive drums 431, the exposures of the exposure devices 433 of the process units 430K, 430Y, 430M and 430C.

The feeding-and-conveying control unit 67 controls the feeding motor 72 and thereby controls the sheet feeding portion 200 (i.e., the pickup roller 202, the feed roller 203 and the retard roller 204) so as to feed the sheet 101. When the control unit 62 receives instruction from the host device or the control unit 63 to feed the sheet 606 from the MPT 500, the control unit 62 causes the feeding-and-conveying control unit 67 to control the feeding motor 71 and to control the MPT 600 (i.e., the feeding roller 601, the pickup roller 602 and the retard roller 603) so as to feed the sheet 606. The feeding-and-conveying control unit 67 also controls the conveying motors 73, 74 and 75 and thereby controls the conveying rollers 304 and the ejection rollers 504*a*, 504*b* and 504*c* so as to convey the sheet 101 (or the sheet 606). Although the feeding motor 71 is provided in the main body 11 of the image forming apparatus 10, it is also possible to provide the feeding motor 71 in the MPT 600.

The belt driving control unit 69 controls the belt driving motor 76 based on the instruction from the control unit 62 and thereby controls the rotation of the driving roller 462 for driving the transfer belt 461. The fixing control unit 70 includes a driving source for rotating the upper roller 501 and the lower roller 502, a power source for heating the halogen lamps 503*a* and 503*b*, and the like, and controls the upper roller 501 and the lower roller 502 and the halogen lamps 503*a* and 503*b* based on the instruction from the control unit 62.

Here, the MPT 600 and respective components for conveying the sheet 606 (fed from the MPT 600) toward the image forming portion 400 constitute a medium feeding device.

Figure 18B:
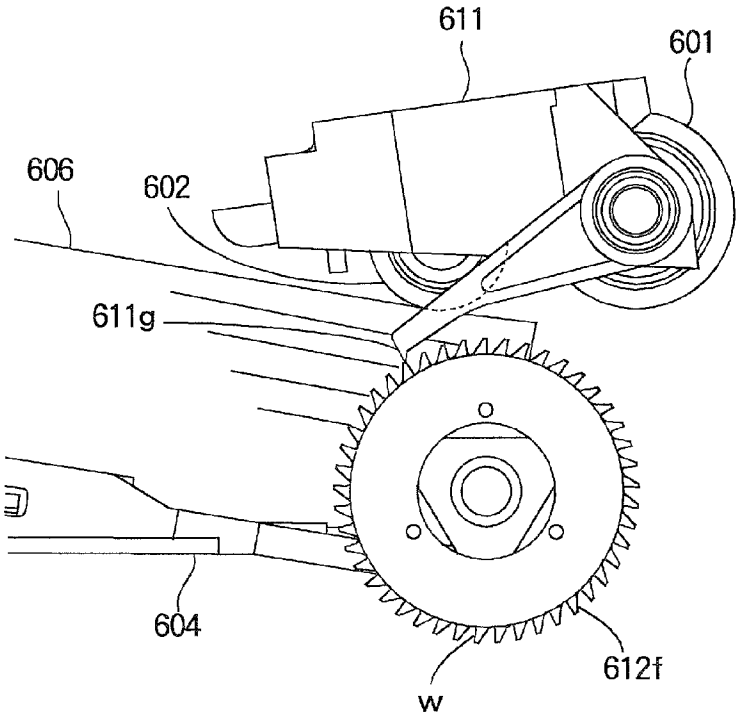
FIGS. 18A and 18B are side views showing an operation of a sheet placing plate of the MPT according to the first embodiment of the present invention.
Figure 18A:
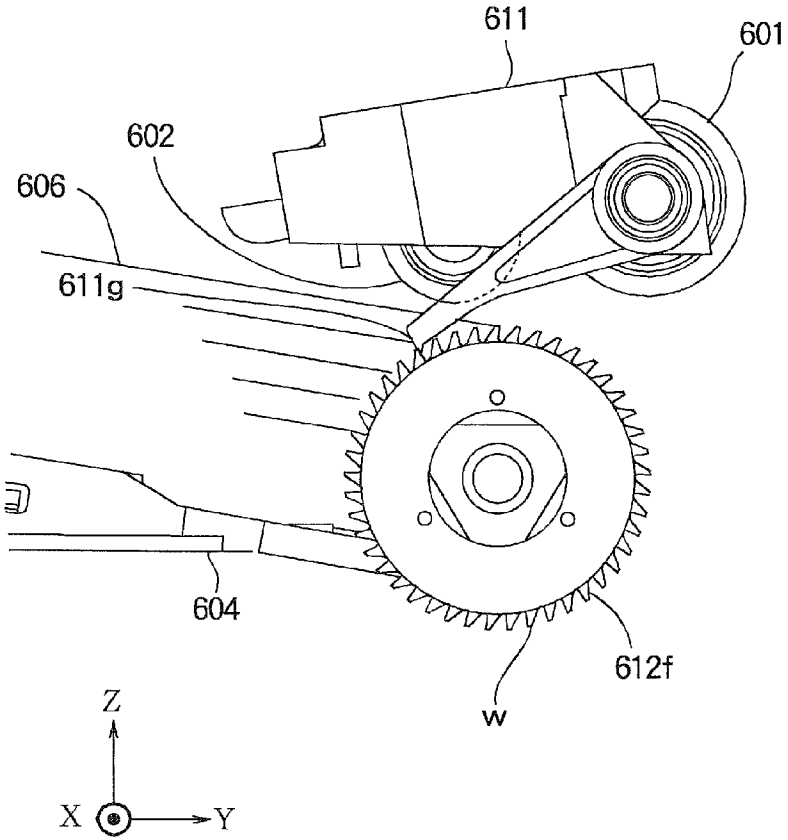
Figure 19:
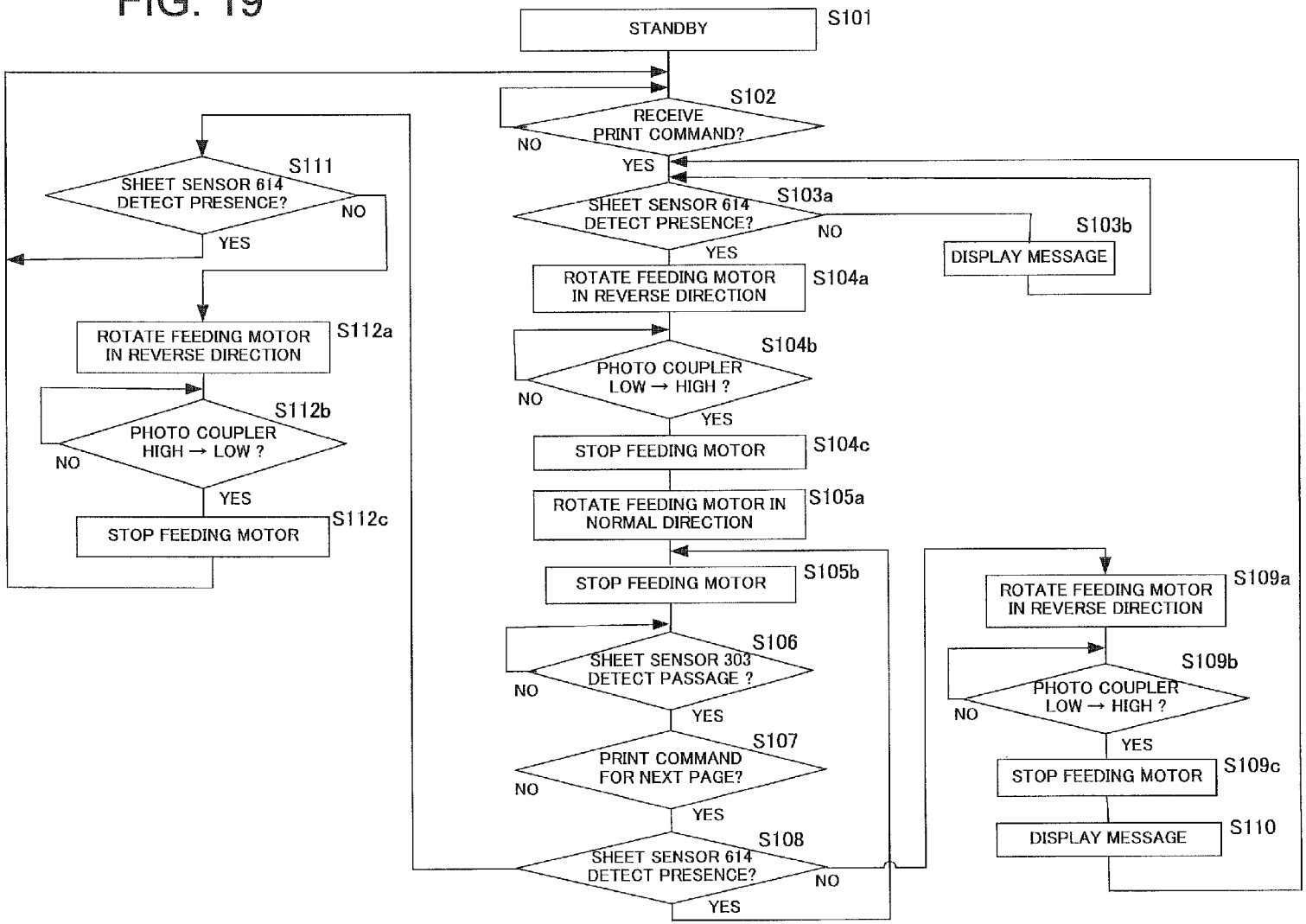
FIG. 19 is a flow chart showing an operation of the MPT according to the first embodiment of the present invention.

Next, an operation of the MPT 600 will be described. FIGS. 18A and 18B are views for illustrating an operation of the sheet placing plate 604 of the MPT 600. FIG. 19 is a flow chart showing an operation of the MPT 60.

In a standby mode (step S101) where the sheets 606 are not placed on the sheet placing plate 604, the lock piece 612*o* is apart from the reset ratchet 612*j*. The sheet placing plate 604 is in a lowermost position (i.e., is not lifted up), and therefore the claw portion 611*g* of the pickup frame 611 engages the elevating ratchet 612*f* (see, FIG. 15).

When the control unit 62 receives printing data and control command from the host device (step S102), the control unit 62 checks the presence or absence of the sheets 606 on the sheet placing plate 604 (step S103*a*) using the sheet sensor 614 (FIG. 4). When the presence of the sheets 606 is not detected by the sheet sensor 614 (NO in step S103*a*), the control unit 62 causes the display panel 63*b* to display a message (for example, an alarm) prompting an operator to set the sheets 606 on the sheet placing plate 604 (step S103*b*). When the presence of the sheets 606 is detected by the sheet sensor 614 (YES in step S103*a*), the control unit 62 causes the feeding motor 71 to start rotation in a reverse direction (step S104*a*).

In this regard, the rotating direction of the feeding motor 71 causing the one-way gear 612*d* in the direction shown by the arrow h (FIG. 10B) is referred to as a "normal direction". The rotating direction of the feeding motor 71 causing the one-way gear 612*d* in the direction shown by the arrow h' is referred to as a "reverse direction".

As shown in FIGS. 12A and 12B, when the feeding motor 71 rotates in the reverse direction, the cam gear 612*m* rotates to move the lock piece 612*o* in the X direction. As the lock piece 612*o* moves in the X direction, the claw portion m of the lock piece 612*o* engages the reset ratchet 612*j*, and locks the rotation of the reset ratchet 612*j*. Therefore, a state where the rotation of the one-way gear 612*d* in the normal direction (i.e., shown by the arrow h) is transmittable to the swinging shaft 605 (FIG. 14A) is reached. Further, when the control unit 62 detects that the output of the photo coupler 612*n* changes from LOW to HIGH (step S104*b*), the control unit 62 causes the feeding-and-conveying control unit 67 to stop the feeding motor 71 (step S104*c*).

Then, the control unit 62 causes the feeding-and-conveying control unit 67 to start the rotation of the feeding motor 71 in the normal direction (step S105*a*). The rotation of the feeding motor 71 in the normal direction is transmitted to the pickup roller 602 via the feeding driving gear 611*d*, and the pickup roller 602 rotates. Further, as was described with reference to FIG. 14A, the one-way gear 612*d* rotates in the direction shown by the arrow h, and the swinging shaft 605 moves upward. As the swinging shaft 605 moves upward, the sheet placing plate 604 (on which the sheets 606 are placed) also moves upward. As the sheet placing plate 604 moves (swings) upward, the uppermost sheet 606 of the stack (i.e., the sheets 606) placed on the sheet placing plate 604 contacts the pickup roller 602 that is rotating, and is fed toward the feeding roller 601.

When the sheet placing plate 604 further moves upward, the sheets 606 on the sheet placing plate 604 push the pickup roller 602 upward, and therefore the pickup frame 611 swings upward. As shown in FIG. 18B, as the pickup frame 611 swings upward, the claw portion 611*g* of the pickup frame 611 moves apart from the elevating ratchet 612*f*, and release the locking on the rotation of the elevation ratchet 612*f*. Therefore, as was described with reference to FIG. 14B, the elevating ratchet 612*f* rotates idly, and the upward movement of the swinging shaft 605 (that is, the upward movement of the sheet placing plate 604) stops.

As several sheets 606 are fed from the sheet placing plate 604, and the number of the sheets 606 on the sheet placing plate 604 decreases, the pickup roller 602 is not pushed by the sheets 606 on the sheet placing plate 604 as shown in FIG. 18A. Therefore, the pickup frame 611 swings downward, and the claw portion 611*g* of the pickup frame 611 engages the elevating ratchet 612*f* again. Therefore, a state where the rotation of the one-way gear 612*d* is transmittable to the swinging shaft 605 is reached (FIG. 14A), and the swinging shaft 605 moves upward to push the sheet placing plate 604 upward.

The control unit 62 stops the rotation of the feeding motor 71 at a predetermined timing before a trailing end of the sheet 606 (which is being fed) passes the pickup roller 602 (step S105*b*). In this state, a leading end of the sheet 606 reaches the conveying rollers 304. Thereafter, the sheet 606 is conveyed by the conveying rollers 304, the transfer belt 461 and the like. While the feeding motor 71 stops, the rotation of the one-way gear 612*d* also stops, and therefore the sheet placing plate 604 does not move upward. However, as shown in FIG. 16A, the lock piece 612*o* engages the reset ratchet 612*j*, and therefore the position of the swinging shaft 605 is maintained. In other words, the sheet placing plate 604 does not move downward.

Thereafter, the control unit 62 waits for the trailing end of the sheet 606 to pass the sheet sensor 303 (FIG. 1) provided on the downstream side of the MPT 600 (step S106), and checks whether there is printing command for printing the next page (step S107).

If there is printing command for printing the next page (YES in step S107), the control unit 62 checks the presence or absence of the sheets 606 on the sheet placing plate 604 using the sheet sensor 614 (step S108). When the presence of the sheets 606 is detected by the sheet sensor 614 (YES in step S108), the control unit 62 repeats the above described processes from the step S105*a*.

When the presence of the sheets 606 is not detected by the sheet sensor 614 (NO in step S108), the control unit 62 causes the feeding motor 71 to start rotating in the reverse direction (step S109*a*). As the feeding motor rotates in the reverse direction, the cam gear 612*m* rotates to move the lock piece 612*o* in the X direction. As the lock piece 612*o* moves in the X direction, the claw portion m of the lock piece 612*o* moves apart from the reset ratchet 612*j*, and releases the locking on the rotation of the reset ratchet 612*j*. As the reset ratchet 612*j* becomes rotatable, the sheet placing plate 604 and the swinging shaft 605 move downward due their own weight as shown in FIG. 16B. Further, the output of the photo coupler 612*n* changes from HIGH to LOW. When the control unit 62 detects that the output of the photo coupler 612*n* changes from HIGH to LOW (step S109*b*), the control unit 62 causes the feeding-and-conveying control unit 67 to stop the feeding motor 71 (step S109*c*). Then, the control unit 62 causes the display panel 63*b* to display a message (for example, an alarm) prompting the operator to set the sheets 606 on the sheet placing plate 604 (step S110), and proceeds to the above described step 103*a*.

Further, in the above described step S107, if there is no printing command for printing the next page (NO in step S107), the control unit 62 determines the presence or absence of the sheets 606 on the sheet placing plate 604 using the sheet sensor (step S111). If the presence of the sheets 606 is detected by the sheet sensor 614 (YES in step S111), the control unit 62 proceeds to the above described step S102. If the presence of the sheets 606 is not detected by the sheet sensor 614 (NO in step S111), the control unit 62 causes the sheet placing plate 604 to move downward (steps S112*a*, S112*b* and S112C) in a similar manner to the above described steps 109*a* through 109*c*, and proceeds to the above described step S102.

In this regard, the sheet 606 fed by the pickup roller 602 is further fed by the feeding roller 601, and is conveyed by the conveying rollers 304 (FIG. 1) toward the image forming portion 400. In the image forming portion 400, the transfer belt 461 absorbs the sheet 606, and conveys the sheet 606 through the process units 430K, 430Y, 430M and 430C. In the process units 430K, 430Y, 430M and 430C, toner images of respective colors are formed on the respective photosensitive drums 431, and are transferred to the sheet 606 on the transfer belt 461. The sheet 606 (to which the toner image is transferred) is conveyed to the fixing portion 500, and the toner image is fixed to the sheet 606. The sheet 606 to which the toner image is fixed is ejected to the stacker portion 505 by the ejection rollers 504*a*, 504*b* and 504*c*.

As described above, according to the first embodiment of the present invention, the sheet placing plate 604 can be moved upward and downward using the feeding motor 71 for rotating the pickup roller 602. Therefore, it is not necessary to provide an exclusive motor for moving the sheet placing plate 604 upward and downward. Further, the number of the sensors required for the movement of the sheet placing plate 604 can be minimized. Accordingly, cost, size and energy consumption of the medium feeding device and the image forming apparatus can be relatively reduced.

Second Embodiment

The second embodiment of the present invention will be described. In the second embodiment, components that are the same as those of the first embodiment are assigned the same reference numerals, and duplicate explanations thereof will be omitted. The second embodiment is different from the first embodiment in the structure of the claw portion 611*g* (615*g*) of the pickup frame 611.

Figure 20B:
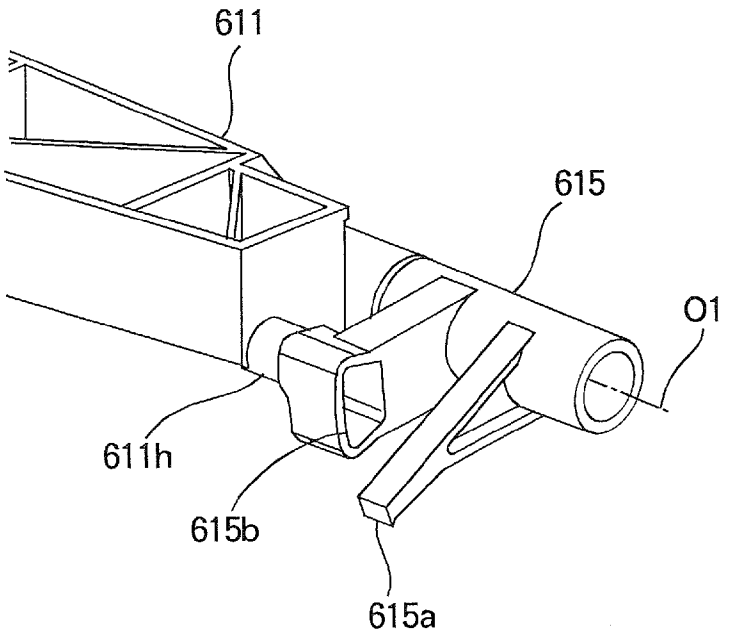
FIGS. 20A and 20B are an exploded perspective view and a perspective view showing a lever portion of a sheet placing plate of an MPT according to the second embodiment of the present invention.
Figure 20A:
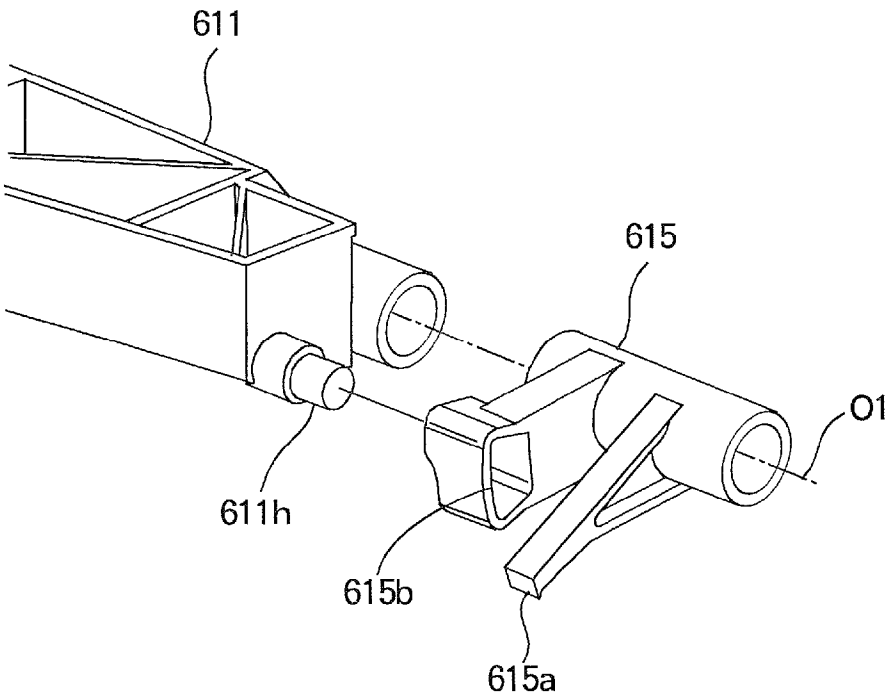

FIG. 20A is a perspective view showing an end portion of the pickup frame 611 in the X direction according to the second embodiment. The pickup frame 611 of the second embodiment includes a lever 615 as a lever member. The lever 615 is provided coaxially on the axis (i.e., the swinging axis of the pickup frame 611). The lever 615 includes a cylindrical body and a claw portion 615*a* formed on the cylindrical body. The claw portion 615*a* has the same shape as the claw portion 611*a* (FIG. 5C) of the first embodiment. The lever 615 also includes a hole portion 615*b* that extends in an arc-shape concentric with the axis O1. A post 611*h* is formed on the end surface of the pickup frame 611. The post portion 611*h* is inserted into the hole portion 615*b*.

The lever 615 is supported by a shaft (not shown) penetrating through the lever 615 so that the lever 615 is swingable about the axis O1. As shown in FIG. 20B, in a state where the lever 615 is mounted to the pickup frame 611, the pickup frame 611 and the lever 615 are independently swingable about the axis O1. Further, since the post portion 611*h* is inserted into the hole portion 615*b* of the lever 615, a swingable range of the lever 615 about the axis O1 is limited.

Figure 21A:
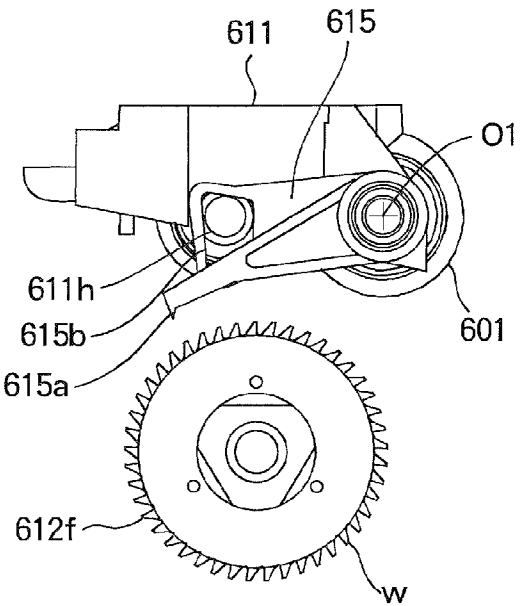
FIGS. 21A, 21B and 21C are schematic views showing an operation of a pickup frame, a lever portion and an elevating ratchet of the MPT according to the second embodiment of the present invention.
Figure 21B:
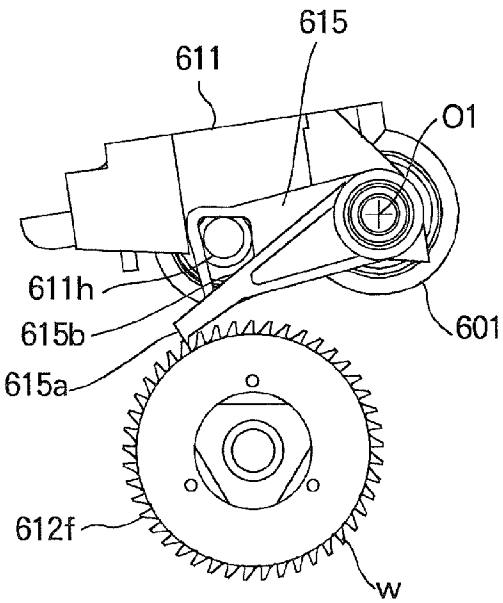
Figure 21C:
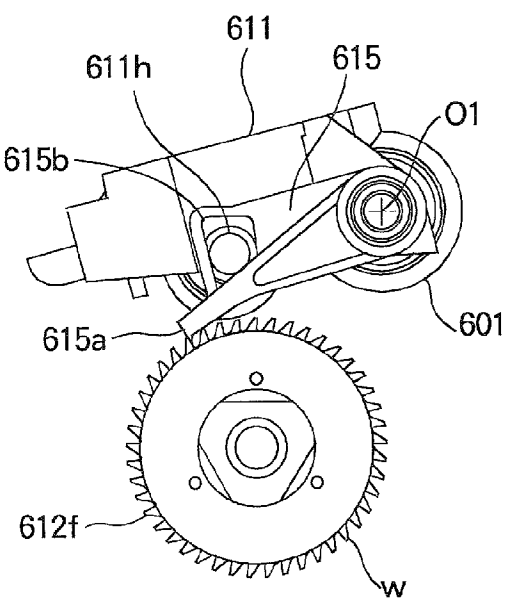
Figure 21C:
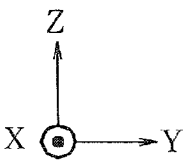

FIGS. 21A, 21B and 21C are schematic view showing a relationship between an operation of the pickup frame 611, the lever 615 and the elevating ratchet 612*f*. FIG. 21A shows a state where the pickup roller 602 is pushed upward by the sheets 606 (omitted in FIG. 21) on the sheet placing plate 604 and the pickup frame 611 swings upward. This corresponds to the state shown in FIG. 18B described in the first embodiment. In this state, the lever 615 swings downward due to its own weight about the axis O1 with respect to the pickup frame 611. Further, the post portion 611*h* contacts an upper surface of the hole portion 615*b* of the lever 615, and prevents the lever 615 from further swinging downward.

FIG. 21B shows a state where the number of sheets 606 on the sheet placing plate 604 decreases, and the pickup frame 611 swings downward. This corresponds to the state shown in FIG. 18A described in the first embodiment. As the pickup frame 611 moves downward, the post portion 611*h* also moves downward while contacting the upper surface of the hole portion 615*b*. Therefore, the lever 615 moves downward, and the claw portion 615*a* of the lever 615 engages the elevating ratchet 612*f*. In this state, the pickup roller 602 held by the pickup frame 611 contacts the upper surface of the sheets 606 (the number of which decreases) on the sheet placing plate 604.

FIG. 21C shows a state where the pickup frame 611 further swings downward from the state shown in FIG. 21B. The pickup frame 611 and the lever 615 are independently swingable in this second embodiment, and therefore the pickup frame 611 can swing further downward even when the claw portion 615*a* of the lever 615 engages the elevating ratchet 612*f* (and therefore the lever 615 does not swings downward). The post portion 611*h* is apart from the upper surface of the hole portion 615*b*.

In the above described first embodiment, as shown in FIG. 18A, the sheet placing plate 604 moves upward and the sheets 606 push the pickup roller 612*f* in a state where the claw portion 611*g* of the pickup frame 611 engages the elevating ratchet 612*f*. Therefore, a biasing force with which the pickup roller 602 abuts against the sheets 606 is also applied to the claw portion 611*g* of the pickup frame 611, with the result that a contacting force between the pickup frame 611 and the sheets 606 may decrease, or a contacting state may become uneven.

In contrast, according to the second embodiment, the lever 615 having the claw portion 615*a* and the pickup frame 611 holding the pickup roller 602 are independently swingable, and therefore the biasing force with which the pickup roller 602 abuts against the sheets 606 is not applied to the claw portion 615*a*.

An operation of the image forming apparatus 10 of the second embodiment is the same as that of the first embodiment. The difference in operation between the first and second embodiments is that the pickup frame 611 is swingable downward even when the claw portion 615*a* of the lever 615 engages the elevating ratchet 612*f*, and that the biasing force with which the pickup roller 602 abuts against the sheets 606 is not applied to the claw portion 615*a* of the lever 615.

As described above, according to the second embodiment of the present invention, the following advantage can be achieved in addition to the advantages of the first embodiment. That is, according to the second embodiment, the contacting state between the pickup roller 602 and the sheets 606 can be made even, and therefore a skew or multiple feeding of the sheets 606 can be surely prevented.

Third Embodiment

The third embodiment of the present invention will be described. In the third embodiment, components that are the same as those of the first and second embodiments are assigned the same reference numerals, and duplicate explanations thereof will be omitted. The third embodiment is different from the first embodiment in the structure of the lift-up gear 612*k*.

Figure 22B:
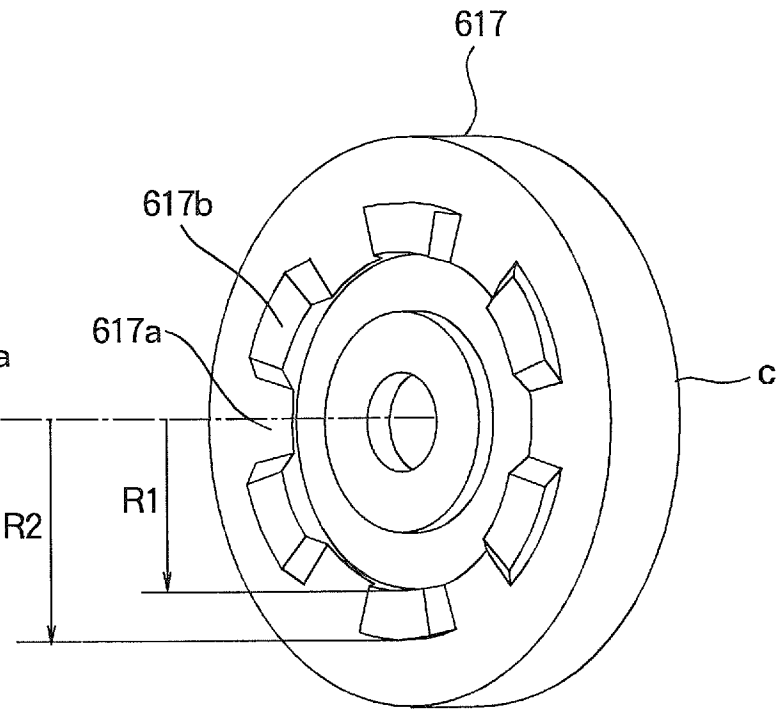
FIGS. 22A and 22B are perspective views respectively showing a lift gear and an internal tooth gear of an MPT according to the third embodiment of the present invention.
Figure 22A:
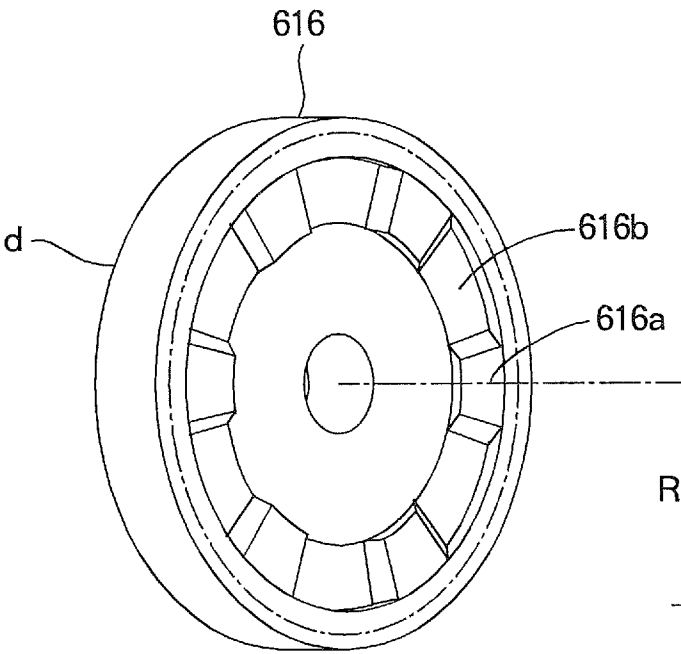

FIGS. 22A and 22B are perspective views of components of a lift-up gear of the third embodiment. The lift-up gear (i.e., the third sub gear) of the third embodiment corresponds to the lift-up gear 612*k* of the first and second embodiments. The lift-up gear of the third embodiment is constituted by a combination of a lift gear 616 as a first member shown in FIG. 22A, and an internal tooth gear 617 as a second member shown in FIG. 22B. The lift gear 616 has an external tooth portion d that meshes with the gear 605*b* (FIG. 11A) of the swinging shaft 605. The internal tooth gear 617 has an internal tooth portion c (FIG. 23) that meshes with the planet gears 612*p* (FIG. 11A).

The lift gear 616 and the internal tooth gear 617 both have substantially disk shape, and face each other in the direction of the rotation axis. The lift gear 616 has convexes 616*a* and concaves 616*b* (i.e., concave-convex surface) on a surface facing the internal tooth gear 617. The convexes 616*a* and concaves 616*b* are arranged alternately and at constant intervals in a circumferential direction of the lift gear 616. The internal tooth gear 617 has concaves 617*a* and convexes 617*b* (i.e., concave-convex surface) on a surface facing the lift gear 617. The concaves 617*a* and convexes 617*b* are arranged alternately and at constant intervals in a circumferential direction of the internal tooth gear 617.

Figure 23B:
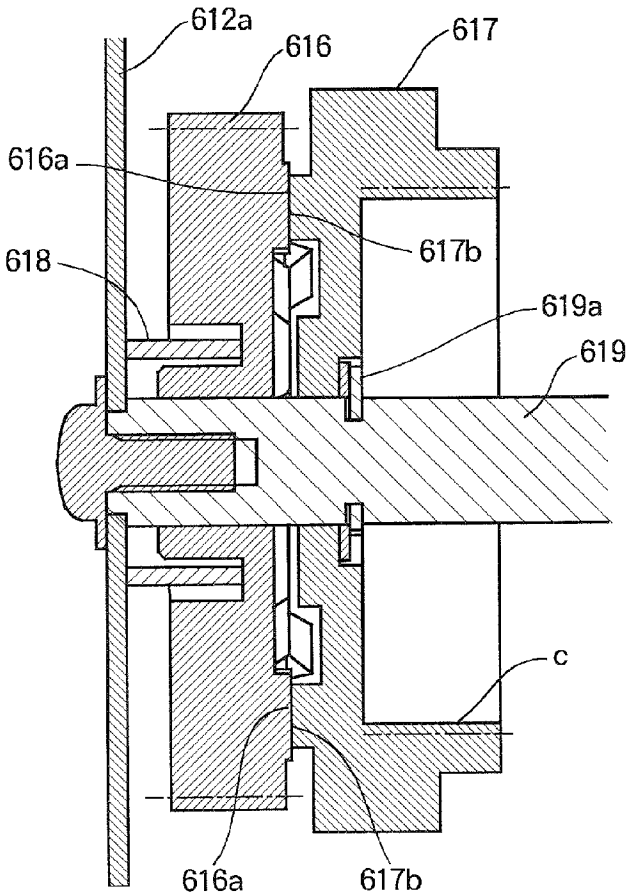
FIGS. 23A and 23B are sectional views showing operations of the lift gear and the internal tooth gear of the MPT according to the third embodiment of the present invention.
Figure 23A:
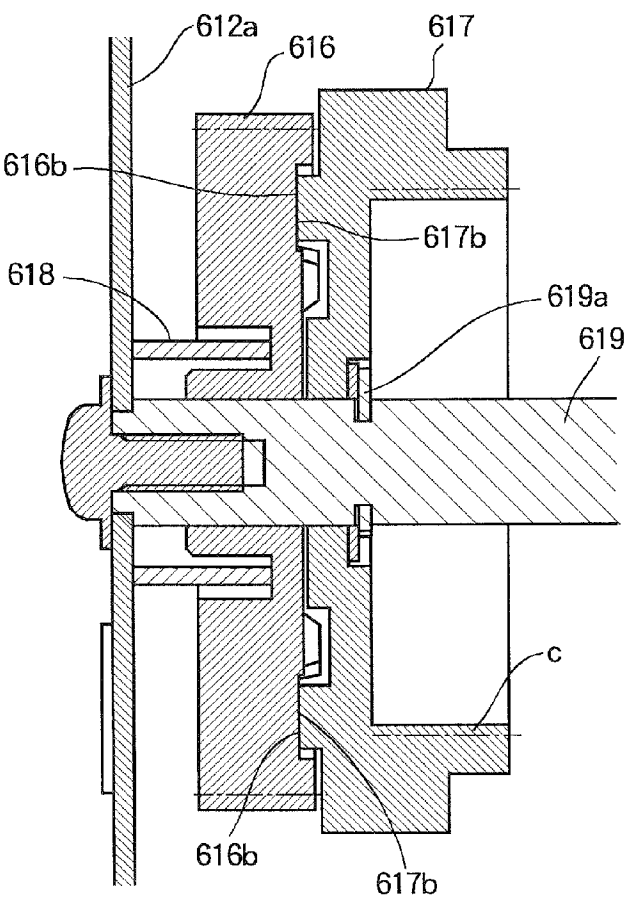

FIG. 23A is a sectional view showing a supporting structure of the lift gear 616 and the internal tooth gear 617. The shaft 619 is fixed to the bracket 612*a* of the driving force transmission portion 612. The shaft 619 rotatably supports the lift gear 616 and the internal tooth gear 617. The shaft 619 is inserted through respective hole portions formed at center portions of the lift gear 616 and the internal tooth gear 61. A stopper ring 619*a* is fixed to the shaft 619 for limiting a position of the internal tooth gear 617 in the axial direction. A spring 618 as a biasing member is provided between the bracket 612*a* and the lift gear 616.

The lift gear 616 is biased by the spring 618 toward the internal tooth gear 617. As shown in FIG. 23A, when the convexes 616*a* and the concaves 616*b* of the lift gear 616 respectively engage the concaves 617*a* and the convexes 617*b* of the internal tooth gear 617, the spring 618 generates a biasing force P. In contrast, as shown in FIG. 23B, when the convexes 616*a* and the concaves 616*b* of the lift gear 616 respectively engage the convexes 617*b* and the concaves 617*a* of the internal tooth gear 617, the spring 618 generates a biasing force P'.

In the usual upward and downward movement of the sheet placing plate 604, the lift gear 616 and the internal tooth gear 617 are coupled with each other in such a manner that the convexes 616*a* engage the concaves 617*a* and the concaves 616*b* engage the convexes 617*b* (FIG. 23A).

Figure 24B:
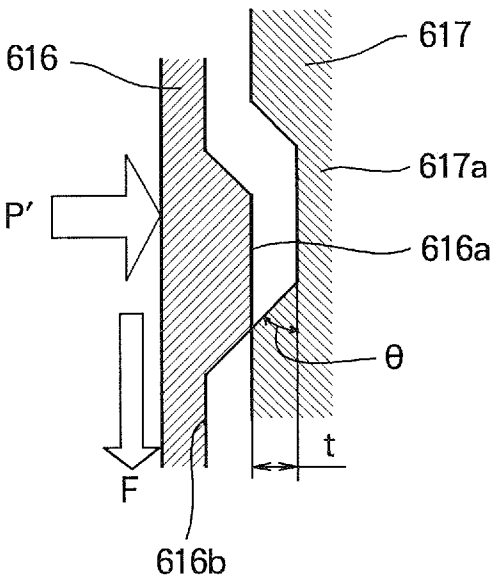
FIGS. 24A and 24B are sectional views showing meshing states between the lift gear and the internal tooth gear of the MPT according to the third embodiment of the present invention.
Figure 24A:
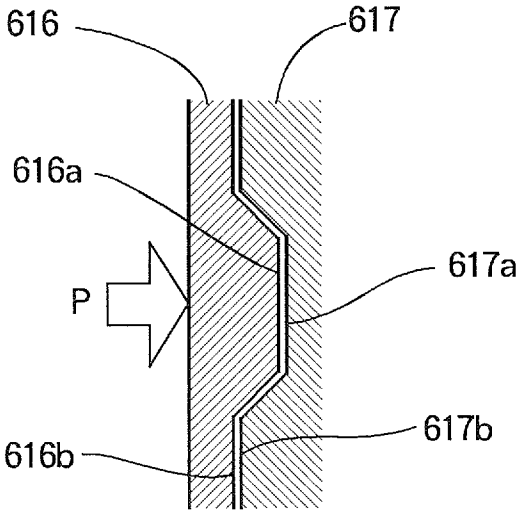

FIG. 24A is an enlarged sectional view showing a state where the convexes 616*a* and the concaves 616*b* of the lift gear 616 engage the concaves 617*a* and the convexes 617*b* of the internal tooth gear 617. FIG. 24B is an enlarged sectional view showing a state where a slip occurs between the lift gear 616 and the internal tooth gear 617. A necessary torque (applied to the lift gear 616) for moving the sheet placing plate 604 (on which the sheets 606 are placed) upward is expressed as a torque T. A torque when the slip occurs between the lift gear 616 and the internal tooth gear 617 as shown in FIG. 24B is expressed as a torque M. The biasing force P' of the spring 618 is set so as to satisfy the relationship: M>T. Therefore, if a torque M greater than the necessary torque. T for moving the sheet placing plate 604 upward is applied to the lift gear 616, the slip occurs between the lift gear 616 and the internal tooth gear 617. Therefore, the lift gear 616, the internal tooth gear 617 and the spring 618 constitute a torque clutch mechanism.

Here, a calculation of the biasing force P' of the spring 618 will be described. An internal radius and an external radius of a region where the convexes and concaves of the lift gear 616 and the internal tooth gear 617 engage each other are respectively expressed as R1 and R2 (FIG. 22B). A tapered angle of the convexes and concaves of the lift gear 616 and the internal tooth gear 617 is expressed as θ. A static friction coefficient between the lift gear 616 and the internal tooth gear 617 is expressed as μ. An equivalent radius R of a circle generating a friction between the lift gear 616 and the internal tooth gear 617 is expressed as follows:

$$R=2/3\times(R2^3-R1^3)/(R2^2-R1^2)$$

A sharing force generated at contact portion between the lift gear 616 and the internal tooth gear 617 is expressed as follows:

$$F=M/R$$

Further, the torque M generating a slip between the lift gear 616 and the internal tooth gear 617 is expressed as follows:

$$M=P'\times R\times(\sin\theta-\mu\cos\theta)/(\cos\theta-\mu\sin\theta)$$

An operation of the MPT of the third embodiment is the same as that of the first embodiment. The difference between the first and third embodiments is that, when the lift gear 616 is applied with the predetermined torque or more, a slip occurs between the lift gear 616 and the internal tooth gear 617. That is, the lift gear 616 rotates idly. Therefore, when the lift gear 616 is applied with a large torque under abnormal conditions (for example, when an operator pushes the sheet placing plate 604 downward in a state where the sheet placing plate 604 is in the uppermost position), the lift gear 616 rotates idly, and therefore components such as gears are prevented from being damaged.

As described above, according to the third embodiment, the following advantages can be achieved in addition to the advantages of the first embodiment. That is, according to the third embodiment, the lift gear 616 rotates idly when the lift gear 616 is applied with the predetermined torque or more, and therefore damage to components can be prevented even when the lift gear 616 is applied with a large torque under abnormal conditions. Further, it becomes possible for the operator to push the sheet placing plate 604 downward in a state where the sheet placing plate 604 is in the uppermost position. For example, if the sheets of incorrect size have been set on the sheet placing plate 604, the sheets can be easily removed from the sheet placing plate 604.

In this embodiment, the torque is generated by bringing substantially disk-shaped members having concave-convex surfaces (i.e., the lift gear 616 and the internal tooth gear 617) into contact with each other. However, this embodiment is not limited to such a configuration, and it is only necessary that a slip occurs when applied with a predetermined torque or more. For example, a torque limiting mechanism using a coil spring, or a torque generating mechanism using a friction plate can be used.

Fourth Embodiment

The fourth embodiment of the present invention will be described. In the fourth embodiment, components that are the same as those of the first, second and third embodiment are assigned the same reference numerals, and duplicate explanations thereof are omitted. The fourth embodiment is different from the first embodiment in that the driving force is transmitted to the pickup roller 602 via a clutch 620.

Figure 25B:
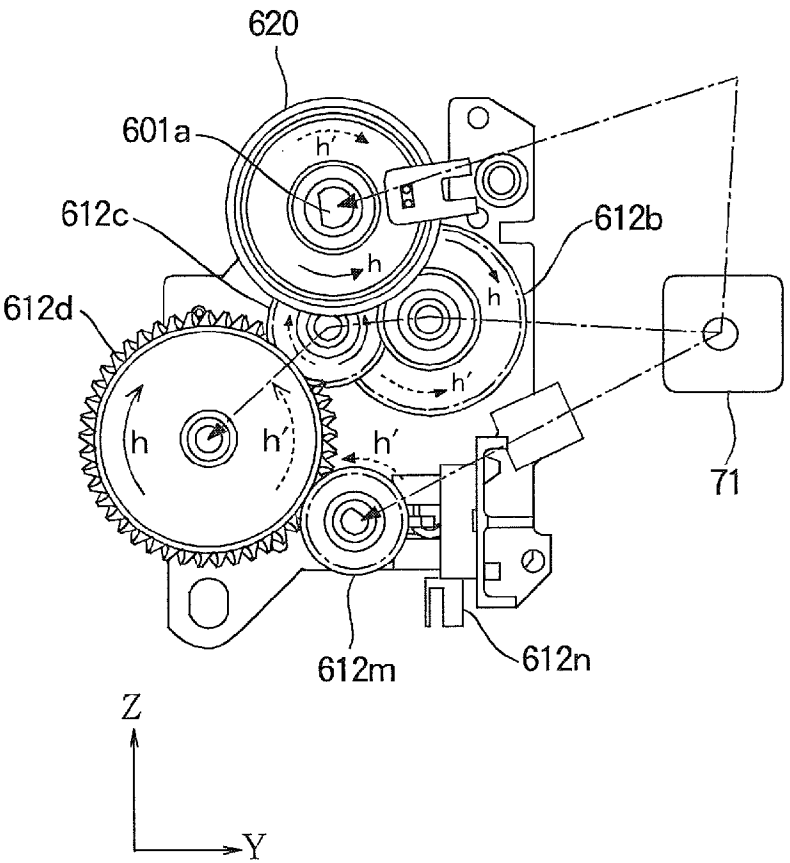
FIG. 25B is a schematic view showing a driving force transmission path of the driving force transmission portion of the MPT according to the fourth embodiment of the present invention.
Figure 25A:
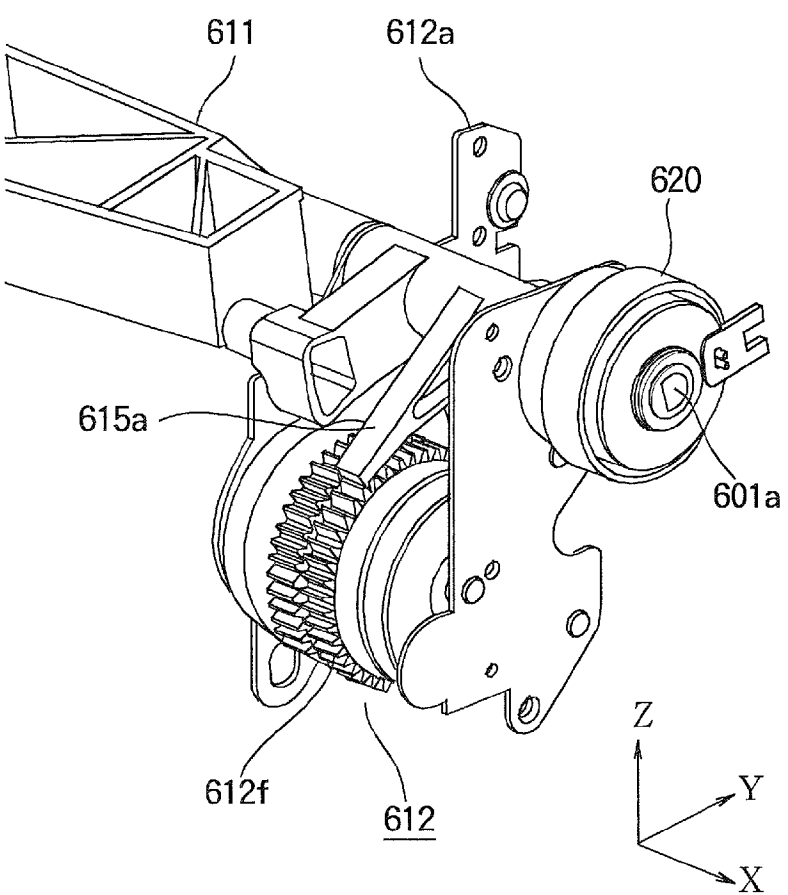
FIG. 25A is a perspective view showing of a driving force transmission portion of an MPT according to the fourth embodiment of the present invention.

FIG. 25A is a perspective view showing the pickup frame 611, the driving force transmission portion 612 and the clutch 620 of the MPT 600 according to the fourth embodiment. FIG. 25B is a schematic view showing a transmission path of the driving force of the feeding motor 71 (i.e., a driving force transmission path) according to the fourth embodiment. In the fourth embodiment, the clutch 620 as a selective transmission unit is used instead of the feeding driving gear 611*d*.

The clutch 620 is provided on an end portion of the shaft 601*a* of the feeding roller 601. The clutch 620 is, for example, an electromagnetic clutch. The clutch 620 connects or disconnects the transmission of the driving force from the feeding motor 71 to the shaft 601*a* of the feeding roller 601. As shown in FIG. 25B, respective gears of the driving force transmission portion 612 rotate in the directions shown by arrows h in order to rotate the feeding roller 601. In contrast, the respective gears of the driving force transmission portion 612 rotate in the directions shown by arrows h' in order to lock the rotation of the reset ratchet 612*j* or release the locking on the rotation of the reset ratchet 612*j* (i.e., in order to move the cam gear 612*m* in the X direction).

Figure 26:
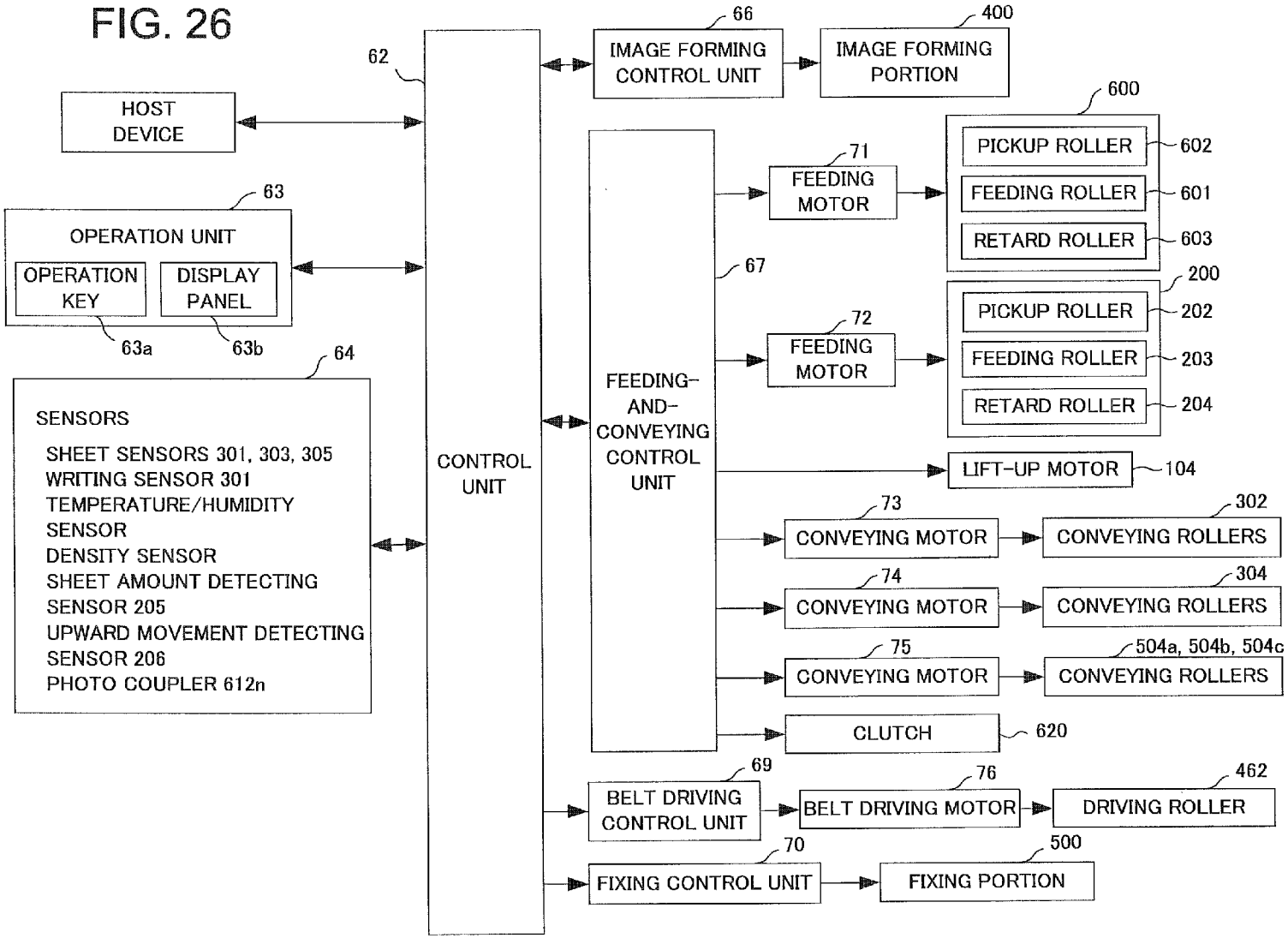
FIG. 26 is a block diagram showing a control system of an image forming apparatus according to the fourth embodiment of the present invention.

FIG. 26 is a block diagram showing a control system of the image forming apparatus 10 of the fourth embodiment. The control system of the image forming apparatus 10 of the fourth embodiment is substantially the same as that of the first embodiment (FIG. 17). However, the control system of the image forming apparatus 10 of the fourth embodiment is different from that of the first embodiment in that the feeding-and-conveying control unit 67 also controls an operation of the clutch 620 based on the instruction from the control unit 62.

Figure 27:
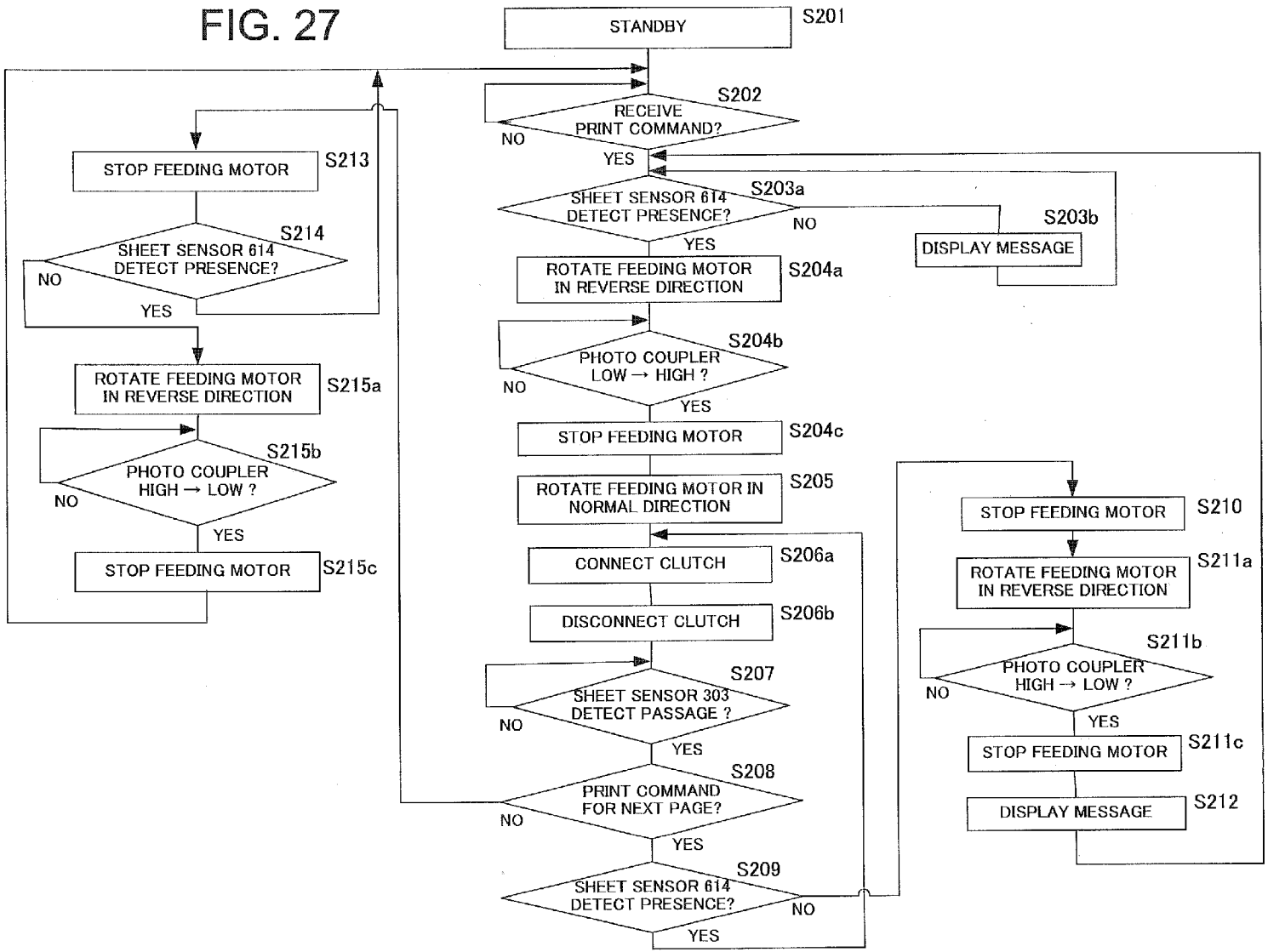
FIG. 27 is a flow chart showing an operation of the MPT according to the fourth embodiment of the present invention.

Next, an operation of the medium feeding device of the fourth embodiment will be described. FIG. 27 is a flow chart showing the operation of the medium feeding device of the fourth embodiment.

In a standby mode (step S201) where the sheets 606 are not placed on the sheet placing plate 604, the lock piece 612*o* is apart from the reset ratchet 612*j*. The sheet placing plate 604 is in a lowermost position (i.e., is not lifted up), and therefore the claw portion 611*g* of the pickup frame 611 engages the elevating ratchet 612*f* (see, FIG. 15).

When the control unit 62 receives printing data and control command from the host device (step S202), the control unit 62 checks the presence or absence of the sheets 606 on the sheet placing plate 604 (step S203*a*) using the sheet sensor 614. When the presence of the sheets 606 is not detected by the sheet sensor 614 (NO in step S203*a*), the control unit 62 causes the display panel 63*b* to display a message (for example, an alarm) prompting the operator to set the sheets 606 on the sheet placing plate 604 (step S203*b*). When the presence of the sheets 606 is detected by the sheet sensor 614 (YES in step S203*a*), the control unit 62 causes the feeding motor 71 to start rotation in the reverse direction (step S204*a*).

When the feeding motor 71 rotates in the reverse direction, the cam gear 612*m* rotates to move the lock piece 612*o* in the X direction. As the lock piece 612*o* moves in the X direction, the claw portion m of the lock piece 612*o* engages the reset ratchet 612*j*, and locks the rotation of the reset ratchet 612*j*. Therefore, a state where the rotation of the one-way gear 612*d* in the normal direction (i.e., shown by the arrow h) is transmittable to the swinging shaft 605 (FIG. 14A) is reached. Further, when the control unit 62 detects that the output of the photo coupler 612*n* changes from LOW to HIGH (step S204*b*), the control unit 62 causes the feeding-and-conveying control unit 67 to stop the feeding motor 71 (step S204*c*).

Then, the control unit 62 causes the feeding-and-conveying control unit 67 to start the rotation of the feeding motor 71 in the normal direction (step S205*a*). The rotation of the feeding motor 71 in the normal direction is continued during a predetermined time period until the sheet placing plate 604 moves upward and the sheets 606 push the pickup roller 602 causing the claw portion 611*g* of the pickup frame 611 (or a lever 615 described in the second embodiment) releases the locking on the rotation of the elevation ratchet 612*f*.

By the rotation of the feeding motor 71 in the normal direction, the one-way gear 612*d* rotates in the direction shown by the arrow h, and the swinging shaft 605 moves upward as shown in FIG. 25B. As the swinging shaft 605 moves upward, the sheet placing plate 604 (on which the sheets 606 are placed) also moves upward. As the sheet placing plate 604 moves upward, the uppermost sheet 606 of the stack (i.e., the sheets 606) placed on the sheet placing plate 604 contacts the pickup roller 602. In this state, the clutch 620 is in a disconnecting state where the clutch 620 does not transmit the driving force.

When the predetermined time period (in which the sheet placing plate 604 moves upward, the sheets 606 push the pickup roller 602; and the locking on the rotation of the elevation ratchet 612*f* is released) has elapsed after the feeding motor 71 start rotating in the normal direction, the control unit 62 causes the feeding-and-conveying control unit 67 to connect the clutch 620 (step S206*a*). That is, the clutch 620 becomes able to transmit the driving force. By connecting the clutch 620, the rotation of the feeding motor 71 in the normal direction is transmitted to the feeding roller 601 and the pickup roller 602, and the sheet 606 is fed.

At predetermined timing before the trailing end of the sheet 606 passes the pickup roller 602, the control unit 62 causes the feeding-and-conveying control unit 67 to disconnect the clutch 620 (step S206*b*). That is, the clutch 620 is brought into the disconnecting state where the clutch 620 does not transmit the driving force.

Thereafter, the control unit 62 waits for the trailing end of the sheet 606 to pass the sheet sensor 303 provided on the downstream side of the MPT 600 (step S207), and checks whether there is printing command for printing the next page (step S208). If there is printing command for printing the next page (YES in step S208), the control unit 62 checks the presence or absence of the sheets 606 on the sheet placing plate 604 using the sheet sensor 614 (step S209). When the presence of the sheets 606 is detected by the sheet sensor 614 (YES in step S209), the control unit 62 repeats the above described processes from the step S206*a*.

In this state, the feeding motor 71 keeps rotating in the normal direction, and therefore the one-way gear 612*d* keeps rotating in the normal direction. Therefore, when the number of the sheets 606 on the sheet placing plate 604 decreases, the sheet placing plate 604 moves upward according to a decreasing number of the sheets 606 as was described in the first embodiment.

When the presence of the sheets 606 is not detected by the sheet sensor 614 (NO in step S209), the control unit 62 stops the feeding motor 71 (step S210), and then causes the feeding motor 71 to rotate in the reverse direction (step S211*a*). As the feeding motor 71 rotates in the reverse direction, the cam gear 612*m* rotates to move the lock piece 612*o* in the X direction. As the lock piece 612*o* moves in the X direction, the claw portion m of the lock piece 612*o* moves apart from the reset ratchet 612*j*, and releases the locking on the rotation of the reset ratchet 612*j*. As the reset ratchet 612*j* becomes rotatable, the sheet placing plate 604 and the swinging shaft 605 move downward due their own weight. Further, the output of the photo coupler 612*n* changes from HIGH to LOW. When the control unit 62 detects that the output of the photo coupler 612*n* changes from HIGH to LOW (step S211*b*), the control unit 62 causes the feeding-and-conveying control unit 67 to stop the feeding motor 71 (step S211*c*). Then, the control unit 62 causes the display panel 63*b* to display a message (for example, an alarm) prompting the operator to set the sheets 606 on the sheet placing plate 604 (step S212), and proceeds to the above described step 203*a*.

Further, in the above described step S208, if there is no printing command for printing the next page (NO in step S208), the control unit 62 stops the feeding motor 71 (step S213) and determines the presence or absence of the sheets 606 on the sheet placing plate 604 using the sheet sensor (step S214). If the presence of the sheets 606 is detected by the sheet sensor 614 (YES in step S214), the control unit 62 proceeds to the above described step S202. If the presence of the sheets 606 is not detected by the sheet sensor 614 (NO in step S214), the control unit 62 causes the sheet placing plate 604 to move downward (steps S215*a*, S215*b* and S215C) in a similar manner to the above described steps 211*a* through 211*c*, and proceeds to the above described step S202.

In the above described first through third embodiments, the upward movement of the sheet placing plate 604 occurs during the feeding operation of the sheet 606 by the pickup roller 602, and therefore there is a possibility that the sheet placing plate 604 moves upward while the sheet 606 is being fed by the pickup roller 602. In contrast, according to the fourth embodiment, the feeding of the sheet 606 is performed while the clutch 620 is connected (step S206*a*), and the upward movement of the sheet placing plate 604 is performed while the clutch 620 is disconnected. In this regard, the decrease in the number of the sheets 606 on the sheet placing plate 604 occurs when the uppermost sheet 606 passes the pickup roller 602. Therefore, the upper movement of the sheet placing plate 604 occurs when the uppermost sheet 606 passes the pickup roller 602 (step S207).

As described above, according to the fourth embodiment, the following advantage can be achieved in addition to the advantages of the first embodiment. That is, according to the fourth embodiment, the feeding operation of the sheet 606 and the upward movement of the sheet placing plate 604 occur in separate time periods. Therefore, multiple feeding and jam of the sheets 606 can be prevented.

In this regard, although an example using the clutch 620 has been described, the fourth embodiment is not limited to such a configuration. It is possible to use a component capable of connecting and disconnecting the transmission of the driving force to the feeding mechanism such as the pickup roller 602. For example, it is possible to use a plunger solenoid or the like instead of the clutch 620.

Fifth Embodiment

The fifth embodiment of the present invention will be described. In the fifth embodiment, components that are the same as those of the first through fourth embodiment are assigned the same reference numerals, and duplicate explanations thereof will be omitted. The fifth embodiment is different from the first embodiment in that the one-way gear 612*d* is driven by the driving forth of the conveying motor 74.

Figure 28:
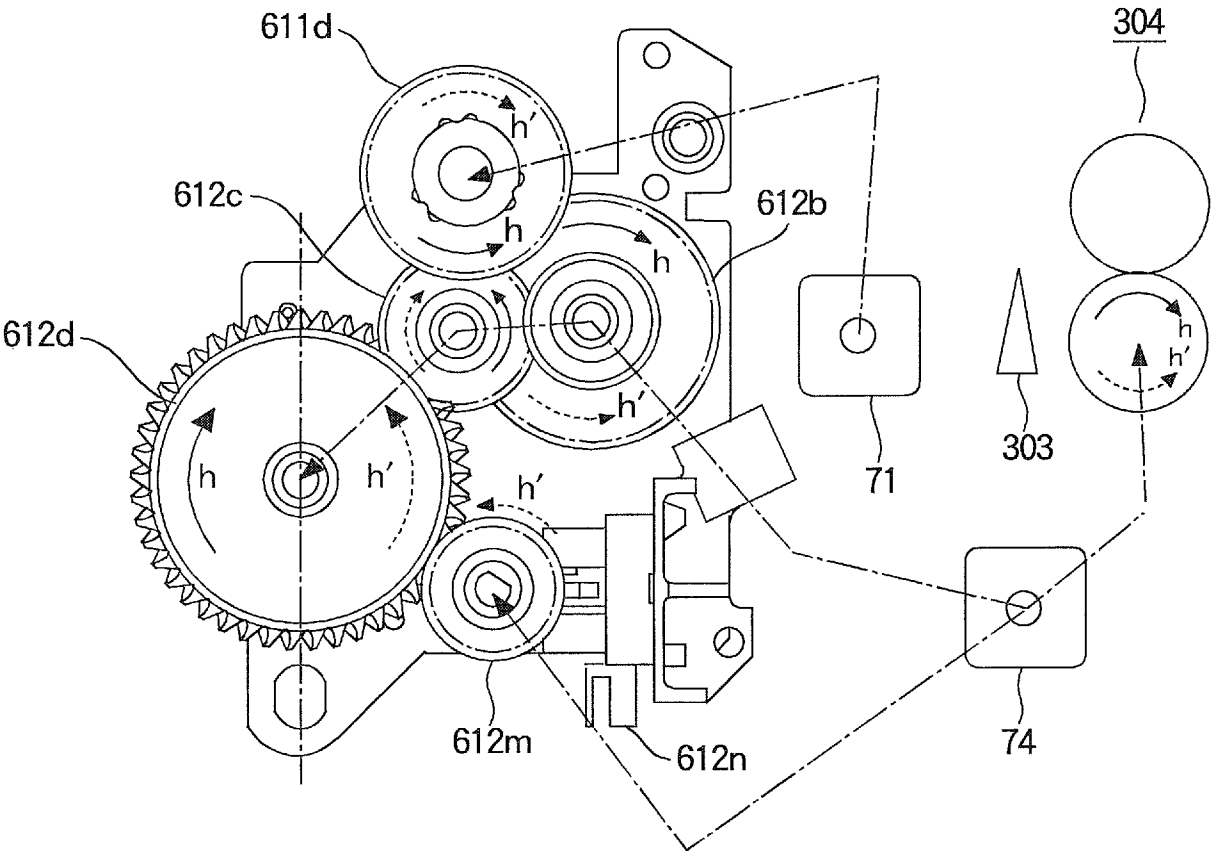
FIG. 28 is a schematic view showing a driving force transmission path of an MPT according to the fifth embodiment of the present invention.

FIG. 28 is schematic view showing a driving force transmission path according to the fifth embodiment. In the fifth embodiment, the upward/downward movement of the sheet placing plate 604 is performed using the driving force generated by the conveying motor 74 (FIG. 17) for driving the conveying rollers 304 (FIG. 1) provided in the main body 11 of the image forming apparatus 10.

The conveying rollers 304 include a one-way clutch mechanism. When the conveying motor 74 rotates in the normal direction, the one-way clutch mechanism transmits the rotation, and the conveying rollers 304 rotate in directions shown by arrows h (solid lines) to convey the sheet 606. In contrast, When the conveying motor 74 rotates in the reverse direction, the one-way clutch mechanism rotates idly (i.e., does not transmit the rotation), and the conveying rollers 304 do not rotate.

As described in the first through third embodiment, the feeding driving gear 611*d* having the one-way clutch mechanism is mounted to the shaft 601*a* of the feeding roller 601. The driving force of the feeding motor 71 is transmitted to the feeding driving gear 611*d*. The configuration and function of the feeding driving gear 611*d* are as described in the first embodiment.

Further, as was described in the first embodiment, the one-way gear 612*d* transmits the rotation in the direction shown by the arrow h (solid line) to the driven gear 612*e* (FIG. 14A), but does not transmit the rotation in the direction shown by the arrow h' (dashed line) to the driven gear 612*e*. The cam gear 612*n* has the one-way clutch mechanism, and rotates only in the direction shown by the arrow h' (solid line).

Figure 29:
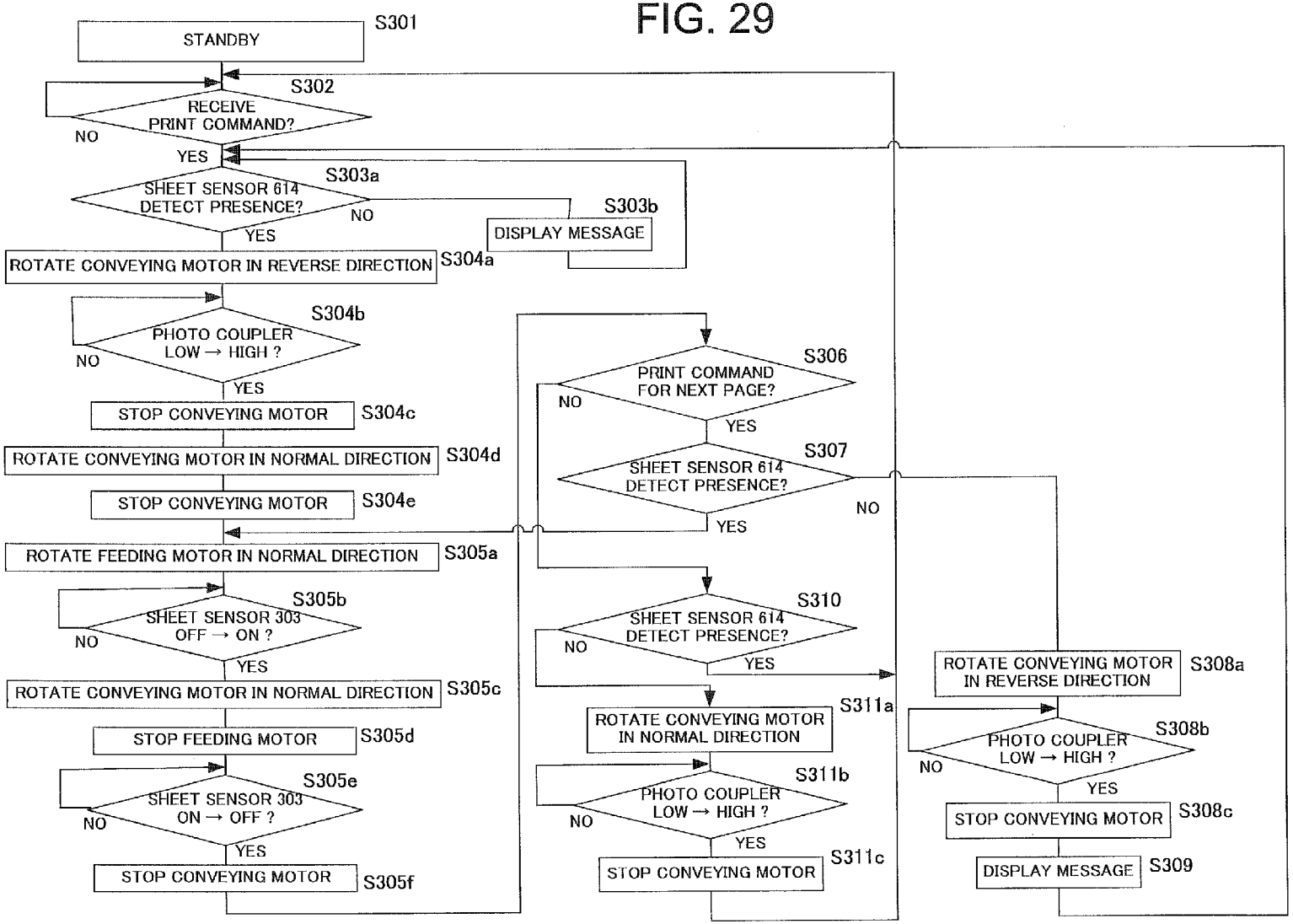
FIG. 29 is a flow chart showing an operation of the MPT according to the fifth embodiment of the present invention.

Next, an operation of the MPT 600 according to the fifth embodiment will be described. FIG. 29 is a flow chart showing the operation of the MPT 600 of the fifth embodiment.

In a standby mode (step S301) where the sheets 606 are not placed on the sheet placing plate 604, the lock piece 612*o* is apart from the reset ratchet 612*j*. The sheet placing plate 604 is in a lowermost position (i.e., is not lifted up), and therefore the claw portion 611*g* of the pickup frame 611 engages the elevating ratchet 612*f* (see, FIG. 15).

When the control unit 62 receives printing data and control command from the host device (step S302), the control unit 62 checks the presence or absence of the sheets 606 on the sheet placing plate 604 (step S303*a*) using the sheet sensor 614. When the presence of the sheets 606 is not detected by the sheet sensor 614 (NO in step S303*a*), the control unit 62 causes the display panel 63*b* to display a message (for example, an alarm) prompting an operator to set the sheets 606 on the sheet placing plate 604 (step S303*b*). When the presence of the sheets 606 is detected by the sheet sensor 614

(YES in step S303*a*), the control unit 62 causes the conveying motor 74 to start rotation in a reverse direction (step S304*a*).

By the rotation of the conveying motor 74 in the reverse direction, the cam gear 612*m* rotates to move the lock piece 612*o* in the X direction. As the lock piece 612*o* moves in the X direction, the claw portion m of the lock piece 612*o* engages the reset ratchet 612*j*, and locks the rotation of the reset ratchet 612*j*. Therefore, a state where the rotation of the one-way gear 612*d* in the normal direction (i.e., shown by the arrow h) is transmittable to the swinging shaft 605 (FIG. 14A) is reached. Further, when the control unit 62 detects that the output of the photo coupler 612*n* changes from LOW to HIGH (step S304*b*), the control unit 62 causes the feeding-and-conveying control unit 67 to stop the conveying motor 74 (step S304*c*).

Then, the control unit 62 causes the feeding-and-conveying control unit 67 to rotate the conveying motor 74 in the normal direction (step S304*d*). By the rotation of the conveying motor 74 in the normal direction, the one-way gear 612*d* rotates in the direction shown by the arrow h, and the swinging shaft 605 moves upward. As the swinging shaft 605 moves upward, the sheet placing plate 604 on which the sheets 606 are placed moves upward. The rotation of the conveying motor 74 in the normal direction is continued until the sheets 606 on the sheet placing plate 604 push the pickup roller 602 and the locking on the rotation of the elevation ratchet 612*f* is released. Then, the control unit 62 stops the conveying motor 74 (step S304*e*).

Then, the control unit 62 causes the feeding-and-conveying control unit 67 to start the rotation of the feeding motor 71 in the normal direction (step S305*a*). The rotation of the feeding motor 71 in the normal direction is transmitted to the pickup roller 602 via the feeding driving gear 611*d*. Therefore, the pickup roller 602 and the feed roller 601 rotate, and feed the sheet 606 from the sheet placing plate 604. When the sheet 606 is detected by the sheet sensor 303 (step S305*b*), it means that the leading end of the sheet 606 reaches the conveying rollers 304. Since the feeding motor 71 keeps rotating in the normal direction, the leading end of the sheet 606 is pushed into a nip portion between the conveying rollers 304 that do not rotate. Therefore, even if a skew of the sheet 606 occurs, the leading end of the sheet 606 becomes parallel to the conveying rollers 304, and the skew of the sheet 606 is corrected.

Then, the control unit 62 causes the feeding-and-conveying control unit 67 to start rotating the conveying motor 74 in the normal direction (step S305*c*). The conveying rollers 304 convey the sheet 606 while sandwiching the sheet 606 therebetween. The control unit 62 stops the normal rotation of the feeding motor 71 (step S305*d*) at a predetermined timing before the sheet 606 passes the pickup roller 602.

Although the feeding motor 71 is stopped at the step S305*e*, the conveying motor 74 keeps rotating in the normal direction. Therefore, as was described in the first embodiment, the sheet placing plate 604 moves upward when the number of the sheets 606 (on the sheet placing place 604) decreases.

The control unit 62 waits for the sheet 606 to pass the sheet sensor 303 (provided on the downstream side of the MPT 600 (step S305*e*), and stops the conveying motor 74 at a timing when the trailing end of the sheet 606 passes the sheet sensor 303 and completely passes the conveying rollers 304 (step S305*f*).

Then, the control unit 62 checks whether there is printing command for printing the next page (step S306). If there is printing command for printing the next page (YES in step S306), the control unit 62 checks the presence or absence of the sheets 606 on the sheet placing plate 604 using the sheet sensor 614 (step S307). When the presence of the sheets 606 is detected by the sheet sensor 614 (YES in step S307), the control unit 62 repeats the above described processes from the step S305*a*.

When the presence of the sheets 606 is not detected by the sheet sensor 614 (NO in step S307), the control unit 62 causes the conveying motor 74 to start rotating in the reverse direction (step S308*a*). By the rotation of the conveying motor 74 in the reverse direction, the cam gear 612*m* rotates to move the lock piece 612*o* in the X direction. As the lock piece 612*o* moves in the X direction, the claw portion m of the lock piece 612*o* moves apart from the reset ratchet 612*j*, and releases the locking on the rotation of the reset ratchet 612*j*. As the reset ratchet 612*j* becomes rotatable, the sheet placing plate 604 and the swinging shaft 605 move downward due their own weight. Further, the output of the photo coupler 612*n* changes from HIGH to LOW. When the control unit 62 detects that the output of the photo coupler 612*n* changes from HIGH to LOW (step S308*b*), the control unit 62 causes the feeding-and-conveying control unit 67 to stop the conveying motor 74 (step S308*c*). Then, the control unit 62 causes the display panel 63*b* to display a message (for example, an alarm) prompting the operator to set the sheets 606 on the sheet placing plate 604 (step S309), and proceeds to the above described step 303*a*.

Further, in the above described step S306, if there is no printing command for printing the next page (NO in step S306), the control unit 62 determines the presence or absence of the sheets 606 on the sheet placing plate 604 using the sheet sensor (step S310). If the presence of the sheets 606 is detected by the sheet sensor 614 (YES in step S310), the control unit 62 proceeds to the above described step S302. If the presence of the sheets 606 is not detected by the sheet sensor 614 (NO in step S310), the control unit 62 causes the sheet placing plate 604 to move downward (steps S311*a*, S311*b* and S311C) in a similar manner to the above described steps 308*a* through 308*c*, and proceeds to the above described step S302.

In the above described fourth embodiment, the clutch 620 is provided for performing the feeding operation of the sheet 606 (by the pickup roller 602) and the upward movement of the sheet placing plate 604 in separate time periods. In contrast, according to the fifth embodiment, the upward/downward movement of the sheet placing plate 604 is performed using the driving force of the conveying motor 74. Therefore, the prevention of multiple feeding and jam of the sheets 606 can be achieved by using the one-way clutch gear (i.e., the feeding driving gear 611*d*) which is less expensive than the clutch 620 (FIG. 25).

Figure 30:
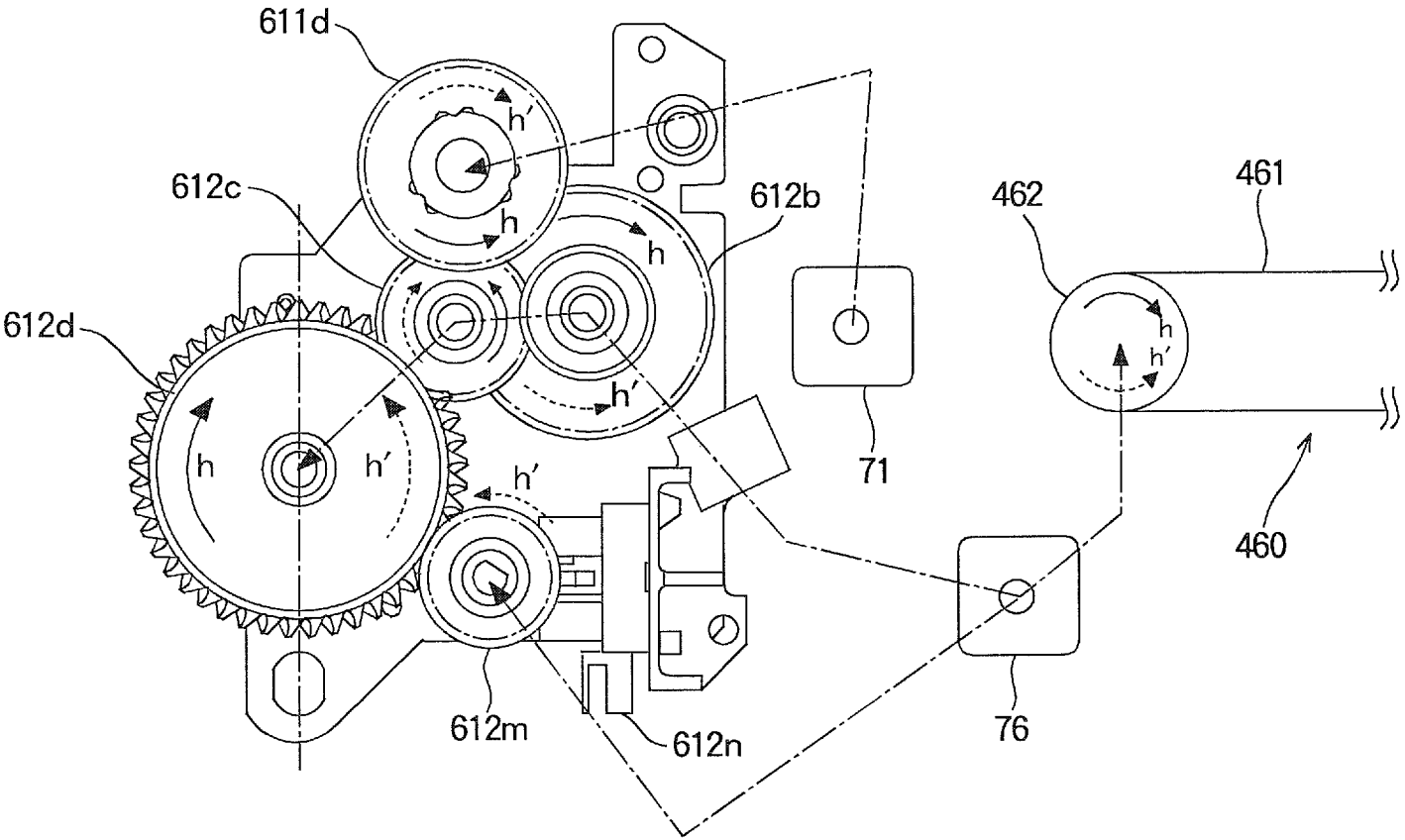
FIG. 30 is a schematic view showing a driving force transmission path of an MPT according to a modification of the fifth embodiment of the present invention.

In this fifth embodiment, the movement of the sheet placing plate 604 is performed using the driving force of the conveying motor 74. However, it is also possible to use a driving force of other motor for feeding or conveying the sheet 606. For example, as shown in FIG. 30, it is possible to use a driving force of a belt driving motor 76 for rotating the driving roller 461 to move the transfer belt 461 of the transfer belt unit 460.

The above described first through fifth embodiments can be variously combined and modified.

In the first through fifth embodiments, the description has been made of the image forming apparatus having four process units and configured to form the toner image directly on the sheet. However, the present invention is not limited to such an image forming apparatus. The present invention is applicable to an apparatus that forms an image on a medium which is conveyed, for example, a color image forming apparatus using an intermediate transfer belt, a monochrome having a single process unit, or the like. Further, the present invention is applicable to a copier, a facsimile an automatic manuscript reading apparatus or the like. Furthermore, it is possible to use other media than sheets. In the above described first through fifth embodiments.

In the first through fifth embodiments, the description has been made of the configuration for moving the sheet placing plate 604 of the MPT 600 upward and downward. However, these embodiments can be applied to a configuration for moving the sheet placing plate 102 of the sheet tray 100 in the image forming apparatus 10.

While the preferred embodiments of the present invention have been illustrated in detail, it should be apparent that modifications and improvements may be made to the invention without departing from the spirit and scope of the invention as described in the following claims.

What is claimed is:

1. A medium feeding device comprising:

a main body;

a medium placing member mounted to said main body so that said medium placing member is movable upward and downward;

a feeding mechanism shiftably mounted to said main body, said feeding mechanism contacting a surface of said medium and feeding said medium in a predetermined direction;

a conveying mechanism for conveying said medium fed by said feeding mechanism;

a lifting unit that moves said medium placing member toward said feeding mechanism;

a medium detecting unit for detecting presence and absence of said medium on said medium placing member;

a driving source for driving at least one of said lifting unit and said conveying mechanism;

a driving force transmission unit for transmitting a driving force of said driving source to said lifting unit, said driving force transmission unit including a first sun gear; and a control unit that controls said driving source, wherein said driving force transmission unit comprises:

a first switching unit that connects or disconnects a transmission of said driving force from said driving source to said lifting unit based on a shifting of said feeding mechanism caused by a movement of said medium placing member, and a second switching unit that connects or disconnects a transmission of said driving force from said driving source to said lifting unit based on control by said control unit, wherein said control unit causes said second switching unit to transmit said driving force to said lifting unit so as to move said medium placing member upward based on detection by said medium detecting unit, wherein, when said medium placing member moves upward to a predetermined position, said first switching unit disconnects said transmission of said driving force to said lifting unit so that said medium placing member is held at said predetermined position, and wherein said control unit causes said second switching unit to disconnect said transmission of said driving force to said lifting unit so that said medium placing member moves downward, wherein said lifting unit includes:

a first planet gear that meshes with an external tooth portion of said first sun gear of said driving force transmission unit;

an internal tooth rack provided so as to face said external tooth portion, said internal tooth rack meshing with said first planet gear, and a swinging member mounted to said planet gear, wherein, when said first sun gear rotates, said first planet gear revolves around said first sun gear, and said swinging member moves upward to cause said medium placing member to move upward.

2. The medium feeding device according to claim 1, wherein said first sun gear has an internal tooth portion, wherein said driving force transmission unit further comprises:

a second planet gear that meshes with said internal tooth gear portion of said first sun gear;

a first carrier that supports said second planet gear so that said second planet gear is revolvable along said internal tooth gear portion of said first sun gear;

a second sun gear having an external tooth portion that meshes with said second planet gear, an internal tooth portion and a one-way clutch;

a third planet gear that meshes with said internal tooth portion of said second sun gear;

a second carrier that supports said third planet gear so that said third planet gear is revolvable along said internal tooth portion of said second sun gear, and a third sun gear having an external tooth portion that meshes with said third planet gear and a one-way clutch, said third sun gear receiving said driving force from said driving source, wherein said first switching unit disconnects said transmission of said driving force from said third planet gear to said second sun gear by allowing said second carrier to rotate to thereby cause said third planet gear to rotate idly, and wherein said second switching unit disconnects said transmission of said driving force from said second planet gear to said first sun gear by allowing said first carrier to rotate to thereby cause said second planet gear to rotate idly.

3. The medium feeding device according to claim 2, wherein, when said first switching unit disconnects said transmission of said force to said lifting unit in a state where said second switching unit transmits said driving force to said lifting unit, said second sun gear does not rotate by an action of said one-way clutch of said second sun gear, so that said second planet gear, said first sun gear and said first planet gear do not rotate, with the result that said medium placing member is held at a lifted position.

4. The medium feeding device according to claim 2, wherein said second switching unit comprises a to-be-engaged portion provided on said first carrier, and an engaging portion provided on a movable body moved by said driving force of said driving source, said engaging portion engaging said to-be-engaged portion of said first carrier, and wherein said control unit causes said movable body to move based on detection by said medium detecting unit so that said engaging portion of said movable body moves apart from said to-be-engaged portion of said first carrier to thereby allow said first carrier to rotate.

5. The medium feeding device according to claim 4, further comprising a detecting unit that detects a position of said movable body so as to detect that said engaging portion of said movable body engages said to-be-engaged portion of said first carrier.

6. The medium feeding device according to claim 2, further comprising a movable supporting body that supports said feeding mechanism, movable supporting body being movable together with said medium placing member, wherein said first switching unit comprises a to-be-engaged portion provided on said second carrier, and an engaging portion provided on said movable supporting body, said engaging portion of said movable supporting body engaging said to-be-engaged portion of said second carrier, and wherein, when said movable supporting body moves upward to a predetermined position, said engaging portion of said movable supporting body moves apart from said to-be-engaged portion of said second carrier to thereby allow said second carrier to rotate.

7. The medium feeding device according to claim 6, wherein said engaging portion is formed on a lever member movably provided on said movable supporting body.

8. The medium feeding device according to claim 2, wherein said driving force transmission unit has a torque clutch mechanism that is disengaged when a torque larger than a predetermined torque is applied to said torque clutch mechanism.

9. The medium feeding device according to claim 8, wherein said torque clutch mechanism comprises:

a first member having a concave-convex surface;

a second member having a concave-convex surface facing said concave-convex surface of said first member, and a biasing member that biases said first and second members so that concave-convex surfaces of said first and second members contact each other.

10. The medium feeding device according to claim 9, wherein said first member constitutes a part of said first sun gear having said external tooth portion, and wherein said second member constitutes another part of said first sun gear having said internal tooth portion.

11. The medium feeding device according to claim 1, wherein said main body comprises:

a frame member that supports said feeding mechanism, said medium detecting unit and said driving force transmission unit;

a cover member that supports said medium placing member, said cover member being movably supported by said frame member, and an arm member that supports said lifting unit and interconnects said frame member and said cover member, wherein said arm member moves in accordance with a movement of said cover member so that said lifting unit moves apart from said driving force transmission unit.

12. The medium feeding device according to claim 1, wherein said feeding mechanism comprises a feeding member provided contacting a medium placed on said medium placing member for feeding said medium, and a movable supporting body that supports said feeding member.

13. The medium feeding device according to claim 12, wherein said feeding mechanism further comprises a separation mechanism for ensuring separation of said medium fed by said feeding member.

14. The medium feeding device according to claim 12, wherein said feeding mechanism has a selective transmission unit that selectively transmits said driving force of said driving source to said feeding member, or does not transmit said driving force of said driving source to said feeding member.

15. The medium feeding device according to claim 14, wherein said selective transmission unit has a one-way clutch mechanism that transmits a rotation of one direction but does not transmit a rotation of another direction.

16. The medium feeding device according to claim 15, wherein said selective transmission unit comprises a clutch mechanism controlled by said control unit.

17. The medium feeding device according to claim 1, wherein said conveying mechanism comprises a conveying roller that conveys said medium fed by said feeding mechanism.

18. The medium feeding device according to claim 1, wherein said conveying mechanism comprises a conveying belt that conveys said medium fed by said feeding mechanism.

19. An image forming apparatus comprising said medium feeding device according to claim 1.

* * * * *